US007091662B2

(12) United States Patent
Hasegawa et al.

(10) Patent No.: US 7,091,662 B2
(45) Date of Patent: Aug. 15, 2006

(54) IMAGE DISPLAY DEVICE AND METHOD OF MANUFACTURING THE SAME

(75) Inventors: Mitsutoshi Hasegawa, Kanagawa (JP); Ihachiro Gofuku, Kanagawa (JP); Masaki Tokioka, Kanagawa (JP); Kazuya Shigeoka, Tokyo (JP); Tokutaka Miura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 10/624,637

(22) Filed: Jul. 23, 2003

(65) Prior Publication Data

US 2004/0135505 A1 Jul. 15, 2004

(30) Foreign Application Priority Data

Jul. 23, 2002 (JP) ..... 2002-213280
Jul. 23, 2002 (JP) ..... 2002-213281

(51) Int. Cl.
*H01J 19/70* (2006.01)

(52) U.S. Cl. ..... 313/555; 313/481; 313/554

(58) Field of Classification Search ..... 313/549, 313/553–555, 481, 496; 445/29, 31; 417/49, 417/51, 48

See application file for complete search history.

(56) References Cited

U.S. PATENT DOCUMENTS

| | | | | |
|---|---|---|---|---|
| 5,223,766 | A | 6/1993 | Nakayama et al. | 313/495 |
| 5,453,659 | A | 9/1995 | Wallace et al. | 313/495 |
| 5,731,660 | A * | 3/1998 | Jaskie et al. | 313/495 |
| 5,936,342 | A | 8/1999 | Ono et al. | 313/495 |
| 6,060,113 | A | 5/2000 | Banno et al. | 427/78 |
| 6,210,245 | B1 | 4/2001 | Sando et al. | 445/6 |
| 6,220,912 | B1 | 4/2001 | Shigeoka et al. | 445/24 |
| 6,278,234 | B1 * | 8/2001 | Ono et al. | 313/495 |
| 6,309,691 | B1 | 10/2001 | Hasegawa | 427/8 |
| 6,422,824 | B1 * | 7/2002 | Lee et al. | 417/48 |
| 6,489,720 | B1 * | 12/2002 | Gofuku et al. | 313/558 |
| 6,514,559 | B1 | 2/2003 | Miyamoto et al. | 427/78 |
| 6,652,343 | B1 * | 11/2003 | Hasegawa et al. | 445/25 |
| 2001/0017526 | A1 | 8/2001 | Abe et al. | 315/169.3 |
| 2003/0058192 | A1 | 3/2003 | Arai et al. | 345/59 |
| 2003/0067263 | A1 | 4/2003 | Tokioka et al. | 313/493 |

FOREIGN PATENT DOCUMENTS

| | | |
|---|---|---|
| JP | 63-181248 | 7/1988 |
| JP | 4-12436 | 1/1992 |
| JP | 9-82245 | 3/1997 |
| JP | 52-091364 | 8/1997 |
| JP | 2000-40469 | 2/2000 |
| JP | 2002-175756 | 6/2002 |
| KR | 1998-061511 | 10/1998 |

* cited by examiner

*Primary Examiner*—Ashok Patel
*Assistant Examiner*—Christopher M. Raabe
(74) *Attorney, Agent, or Firm*—Fitzpatrick, Cella, Harper & Scinto

(57) ABSTRACT

In an image display device having in an airtight container an electron source and an image display member that receives electrons from the electron source, an evaporating getter and a non-evaporating getter are stacked in the airtight container. This makes it possible to maintain the vacuum level in the airtight container. The image display device thus obtains a prolonged life and a stable display operation.

14 Claims, 17 Drawing Sheets

PROCESS STEP FLOW

IMAGE DISPLAY DEVICE AND METHOD OF MANUFACTURING THE SAME

BACKGROUND OF THE INVENTION

1. Field of the Invention

The present invention relates to an image display device constructed by using an electron source and a method of manufacturing the display device.

2. Related Background Art

In a device which displays an image using a phosphor that serves as an image display member and emits light when irradiated with an electron beam from an electron source, the vacuum level in the interior of a vacuum container that houses the electron source and the image display member has to be kept high. This is because gas generated in the vacuum container raises the pressure and adversely affects the electron source, though the degree of adverse affect varies depending on the type of gas, to lower the electron emission amount and the brightness of a displayed image. In addition, gas generated in the vacuum container could be ionized by the electron beam and the resultant ion is accelerated by an electric field, which is for accelerating electrons, to bump and damage the electron source. Furthermore, in some cases, gas in the vacuum container induces electric discharge that can destroy the whole display device.

Usually, a vacuum container of an image display device is obtained by combining glass members and bonding them at the juncture with flit glass or the like. Once the joining is completed, the pressure is maintained by a getter set in the vacuum container.

In a normal CRT, an alloy mainly containing Ba is energized or heated using high frequency wave in a vacuum container to form a thin evaporation film on the inner wall of the container. The evaporation film adsorbs gas generated in the vacuum container and the high vacuum level is thus maintained.

Lately, development of a flat panel display with an electron source that has a large number of electron-emitting devices arranged on a flat substrate has been advanced. In ensuring the vacuum level, gas generated from an image display member reaches the electron source before dispersed and sent to a getter to thereby cause a local pressure rise and resultantly degradation of the electron source, which is a problem characteristic to this type of display.

In order to solve this problem, a specific structure for a flat panel display has been disclosed in which gas is adsorbed, as soon as it is generated, by a getter material placed in an image display region.

For instance, Japanese Patent Application Laid-Open No. 04-12436 discloses a method of forming from a getter material a gate electrode which is provided in an electron source to extract an electron beam. Shown as examples in this publication are a field emission type electron source that uses a conical protrusion for a cathode and a semiconductor electron source having a pn junction.

Japanese Patent Application Laid-Open No. 63-181248 discloses a method of forming a getter material film on a control electrode, namely, an electrode (grid or the like) for controlling an electron beam, which is placed between a cathode group and a face plate of a vacuum container in a flat panel display.

U.S. Pat. No. 5,453,659 (Anode Plate for Flat Panel Display having Integrated Getter, issued 26 Sep. 1995 to Wallace et al.) discloses a display in which getter members are formed in gaps between phosphors that form a stripe pattern on an image display member (anode plate). In this example, a getter material is electrically isolated from a phosphor and from a conductor that is electrically connected to the phosphor. An appropriate electric potential is given to the getter to radiate and heat electrons emitted from an electron source, and the getter is thus activated.

For an electron-emitting device which constitutes an electron source for use in a flat panel display, obviously one having a simple structure easy to fabricate is desirable in light of production technique, manufacturing cost, and the like. Specifically, an electron-emitting device that is in demand is one whose manufacturing process consists of layering thin films and simple working or, if a large-sized electron source is to be obtained, one manufactured by printing or other technique that does not need a vacuum device.

The above electron source, which is disclosed in Japanese Patent Application Laid-Open No. 04-12436 and which has a gate electrode formed from a getter material, requires laborious processes inside a vacuum apparatus in manufacturing a conical cathode chip or in joining the semiconductors. Furthermore, its manufacturing apparatus puts limitations on making this electron source larger.

As to the display device which is disclosed in Japanese Patent Application Laid-Open No. 63-181248 and which has a control electrode between an electron source and a face plate, the structure is complicated and the manufacturing process entails laborious processes such as positioning of those members.

The method disclosed in U.S. Pat. No. 5,453,659, in which a getter material is formed on an anode plate, needs electric insulation between the getter material and a phosphor and requires a large-sized photolithography device for precise, minute working. Accordingly, an image display device manufactured by this method is limited in size.

In contrast, a lateral field emission type electron-emitting device and a surface conduction electron-emitting device are electron-emitting devices that meet the above demand, namely, to have a structure easy to fabricate.

A lateral field emission type electron-emitting device has, on a flat substrate, opposing cathodes (gates) that are provided with pointed electron-emitting regions. A thin film deposition method such as evaporation, sputtering, or plating and a normal photolithography technique are employed to manufacture a lateral field emission type electron-emitting device.

A surface conduction electron-emitting device emits electrons by letting a current flow in a conductive thin film a part of which is a highly resistant portion.

An electron source using a lateral field emission type electron-emitting device and an electron source using a surface conduction electron-emitting device have neither the gate electrode shaped as disclosed in JP 04-12436 A nor the control gate disclosed in Japanese Patent Application Laid-Open No. 63-181248. Placing a getter in an image display region by a method similar to the one in those publications is therefore not an option for such electron sources, and getters are placed outside of their respective image display regions.

As mentioned above, the most prolific sources of gas out of components of an image display device are an image display region, which is formed from a fluorescent film or the like and which high energy electrons impact on, and the electron source itself. Generation of gas could be prevented by thorough degasification treatment, such as slow baking at high temperature. However, in practice, thorough degasification treatment is not always successfully carried out because electron-emitting devices and other members are damaged by heat and there is a strong possibility left that gas is generated.

In the case where the gas pressure rises locally and instantly, ions accelerated by an electric field collide against other gas molecules and cause incessant ion creation, which could induce electric discharge. The electric discharge can partially destroy the electron source to degrade the electron emission characteristic. Gas generated from an image display member causes electron emission after the image display device is built and it starts rapid discharge of gas of water or the like contained in the phosphor. This can lead to apparent lowering in luminance of an image at an early stage after the start of driving. As driving is continued, now the periphery of the electron source too discharges gas and the characteristic is degraded gradually. When a getter region is provided only on the outside of the display region as in prior art, gas generated near the center of the image display region takes long to reach the outside getter region and, moreover, is re-adsorbed by the electron source before adsorbed by the getter. Therefore the getter region cannot exert a significant effect in preventing degradation of the electron emission characteristic and lowering in luminance of an image is particularly noticeable at the center of the image display region.

On the other hand, when a getter member is placed to remove generated gas quickly inside an image display region of a flat panel display that does not have the above gate electrode or control gate, lowering in luminance of an image is noticeable outside the image display region because of gas generated outside of the display region.

In the case where a getter activation method shown in JP 09-82245 A is employed, heater wiring dedicated to getter activation is laid out to complicate the simplified process again. If a getter is activated by electron beam irradiation, load is applied to an electron beam to degrade the electron source while the display device is not driven.

SUMMARY OF THE INVENTION

The present invention has been made in view of the above and, therefore, an object of the present invention is to provide an image display device which is changed less in luminance with time (less deterioration with age).

Another object of the present invention is to provide an image display device in which luminance fluctuation with time is reduced in an image display region.

According to an aspect of the present invention, there is provided an image display device including in an airtight container an electron source, an image display member, and a getter, the image display member facing the electron source to receive electrons from the electron source, and, the getter being obtained by stacking an evaporating getter and a non-evaporating getter in the airtight container.

Further, according to another aspect of the present invention, there is provided a method of manufacturing an image display device, including the steps of:

stacking an evaporating getter and a non-evaporating getter on an image display member of a first substrate; and sealing the first substrate which has the getters and a second substrate which has an electron source after the second electrode is placed, in a vacuum atmosphere, opposite to the first electrode while the image display member and the electron source face each other across a gap.

Further, according to another aspect of the present invention, there is provided a method of manufacturing an image display device that has in an airtight container an electron source and an image display member, the electron source having a plurality of electron-emitting devices arranged in accordance with matrix wiring on a substrate, the image display member having a fluorescent film and opposing the substrate, the method including the steps of:

placing a non-evaporating getter on the image display member;

setting the substrate of the electron source, the image display member on which the non-evaporating getter is placed, and a supporting frame in a vacuum atmosphere;

baking the substrate of the electron source, the image display member, and the supporting frame in a vacuum atmosphere;

forming an evaporating getter on the non-evaporating getter by flashing; and sealing, by bonding the substrate of the electron source and the image display member to each other while the supporting frame is sandwiched between the two, the airtight container.

Further, according to another aspect of the present invention, there is provided a method of manufacturing an image display device that has in an airtight container an electron source and an image display member, the electron source having a plurality of electron-emitting devices arranged in accordance with matrix wiring on a substrate, the image display member having a fluorescent film and opposing the substrate, the method including the steps of:

setting the substrate of the electron source, the image display member, and a supporting frame in a vacuum atmosphere;

baking the substrate of the electron source, the image display member, and the supporting frame in a vacuum atmosphere; and sealing, by bonding the substrate of the electron source and the image display member to each other while the supporting frame is sandwiched between the two, the airtight container, in which a step of placing a non-evaporating getter on the image display member in a vacuum atmosphere and a step of forming an evaporating getter on the non-evaporating getter by flashing are put, at the latest, before the sealing step.

DETAILED DESCRIPTION OF THE PREFERRED EMBODIMENTS

Figure 1A:
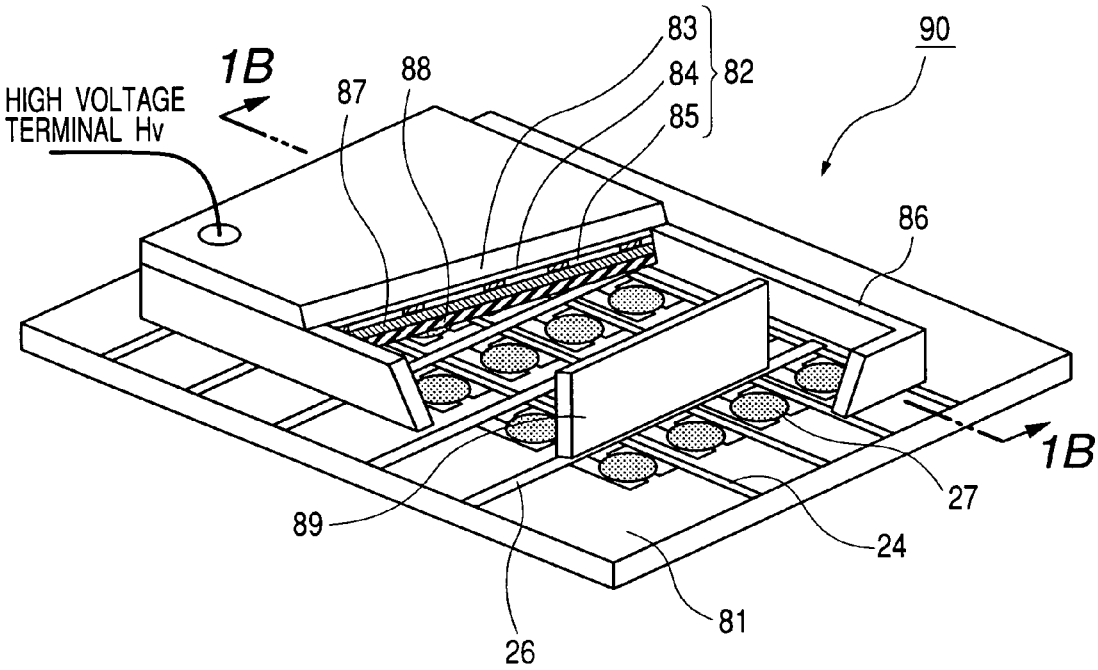
FIGS. 1A and 1B are schematic diagrams showing a structural example of an image display device of the present invention.

An image display device according to the present invention has in an airtight container an electron source, an image display member, and a getter, the image display member facing the electron source to receive electrons from the electron source, and the image display device is characterized in that the getter is obtained by stacking an evaporating getter and a non-evaporating getter in the airtight container.

Further, according to the above image display device, the getter is preferably placed on the image display member.

Further, according to the above image display device, the getter preferably extends over a region of the image display member that receives the electrons.

Further, according to the above image display device, a non-evaporating getter is preferably placed first on the getter placement face and then an evaporating getter is laid on the non-evaporating getter to constitute the getter.

Further, according to the above image display device, the evaporating getter is preferably thinner than the non-evaporating getter.

According to the above image display device, as other preferable characteristics, it is desirable that: the main component of the non-evaporating getter is Ti;

the non-evaporating getter is 300 Å to 1000 Å in thickness;

the main component of the evaporating getter is Ba;

the electron-emitting device is a surface conduction electron-emitting device; and the electron-emitting device is a lateral field emission type electron-emitting device.

Further, a method of manufacturing an image display device according to the present invention is characterized by including the steps of:

stacking an evaporating getter and a non-evaporating getter on an image display member of a first substrate; and sealing the first substrate which has the getters and a second substrate which has an electron source after the second electrode is placed, in a vacuum atmosphere, opposite to the first electrode while the image display member and the electron source face each other across a gap.

Further, according to the method of manufacturing an image display device as described above, it is preferable that the step of stacking the evaporating getter and the non-evaporating getter include a step of placing the non-evaporating getter on the image display member and a step of placing the evaporating getter on the non-evaporating getter in a vacuum atmosphere.

Further, according to the method of manufacturing an image display device as described above, it is preferable that the step of stacking the evaporating getter and the non-evaporating getter include a step of placing the non-evaporating getter on the image display member and a step of placing the evaporating getter on the non-evaporating getter in a vacuum atmosphere after the first substrate having the non-evaporating getter is baked in a vacuum atmosphere.

Further, according to the method of manufacturing an image display device as described above, it is preferable that the step of stacking the evaporating getter and the non-evaporating getter include a step of placing the non-evaporating getter on the image display member in a vacuum atmosphere and a step of placing the evaporating getter on the non-evaporating getter in a vacuum atmosphere after the first substrate having the non-evaporating getter is baked in a vacuum atmosphere.

Further, according to the method of manufacturing an image display device as described above, it is preferable that the step of stacking the evaporating getter and the non-evaporating getter include a step of placing the non-evaporating getter on the image display member in a vacuum atmosphere after the first substrate is baked in a vacuum atmosphere and a step of placing the evaporating getter on the non-evaporating getter in a vacuum atmosphere.

Further, according to the method of manufacturing an image display device as described above, it is preferable that the step of stacking the evaporating getter and the non-evaporating getter include a step of placing the evaporating getter on the image display member in a vacuum atmosphere after the first substrate is baked in a vacuum atmosphere and a step of placing the non-evaporating getter on the evaporating getter in a vacuum atmosphere.

Further, according to the method of manufacturing an image display device as described above, it is preferable that the baking be performed at 250° C. or higher and 450° C. or lower.

Further, according to the method of manufacturing an image display device as described above, it is preferable that the flashing step of the evaporating getter be performed at a temperature of 250° C. or lower.

Further, according to the method of manufacturing an image display device as described above, it is preferable that the non-evaporating getter mainly contain Ti.

Further, according to the method of manufacturing an image display device as described above, it is preferable that the evaporating getter mainly contain Ba.

According to the present invention, a method of manufacturing an image display device that has in an airtight container an electron source and an image display member, the electron source having a plurality of electron-emitting devices arranged in accordance with matrix wiring on a substrate, the image display member having a fluorescent film and opposing the substrate, is characterized by including the steps of:

placing a non-evaporating getter on the image display member;

setting, in a vacuum atmosphere, the substrate of the electron source, the image display member on which the non-evaporating getter is put, and a supporting frame;

baking, in a vacuum atmosphere, the substrate of the electron source, the image display member, and the supporting frame;

forming an evaporating getter on the non-evaporating getter by flashing; and sealing, by bonding the substrate of the electron source and the image display member to each other while the supporting frame is sandwiched between the two, the airtight container.

According to the image display device manufacturing method of the present invention, as other preferable characteristics, it is desirable that: the baking is a heat treatment step performed at 250° C. or higher and 450° C. or lower;

the baking doubles as a step of activating the non-evaporating getter; and the flashing step of the evaporating getter is performed at 250° C. or lower.

Further, a method of manufacturing an image display device according to the present invention, the device having in an airtight container an electron source and an image display member, the electron source having a plurality of electron-emitting devices arranged in accordance with matrix wiring on a substrate, the image display member having a fluorescent film and opposing the substrate, is characterized by including the steps of:

setting the substrate of the electron source, the image display member, and a supporting frame in a vacuum atmosphere;

baking the substrate of the electron source, the image display member, and the supporting frame in a vacuum atmosphere; and sealing, by bonding the substrate of the electron source and the image display member to each other while the supporting frame is sandwiched between the two, the airtight container, and is characterized in that a step of placing a non-evaporating getter on the image display member in a vacuum atmosphere and a step of forming an evaporating getter on the non-evaporating getter by flashing are put, at the latest, before the sealing step.

According to the image display device manufacturing method of the present invention, as other preferable characteristics, it is desirable that: the baking step is performed at a temperature of 250° C. or higher and 450° C. or lower;

the flashing step of the evaporating getter is put, at the earliest, after the baking step;

the flashing step of the evaporating getter is performed at a temperature of 250° C. or lower;

the non-evaporating getter mainly contains Ti; and the evaporating getter mainly contains Ba.

According to the image display device of the present invention described above, a non-evaporating getter and an evaporating getter are stacked on the image display member within the image display region so that getter materials are placed in the vicinity of the portion that generates gas most while covering a wide area. As a result, gas generated in the airtight container after the sealing step is quickly adsorbed by the getter materials and the vacuum level in the airtight container is kept well. The amount of electrons emitted from the electron-emitting devices is thus stabled.

According to the image display device manufacturing method of the present invention described above, getter characteristic loss can readily be prevented and it is made easier to improve vacuum and prolong the life of the electron-emitting devices.

A preferred embodiment mode of the present invention will be described in detail below with reference to the accompanying drawings. Note that the dimensions, materials, shapes, positional relations, etc. of components mentioned in this embodiment mode are given as examples and are not to limit the scope of the present invention.

An image display device of the present invention has an electron source and an image display member in an airtight container, which is a vacuum container. The electron source has a plurality of electron-emitting devices arranged in accordance with matrix wiring on a substrate. The image display member has a fluorescent film and is placed so as to face the electron source substrate.

Now, a description is given on each component of the image display device of the present invention.

Figure 14A:
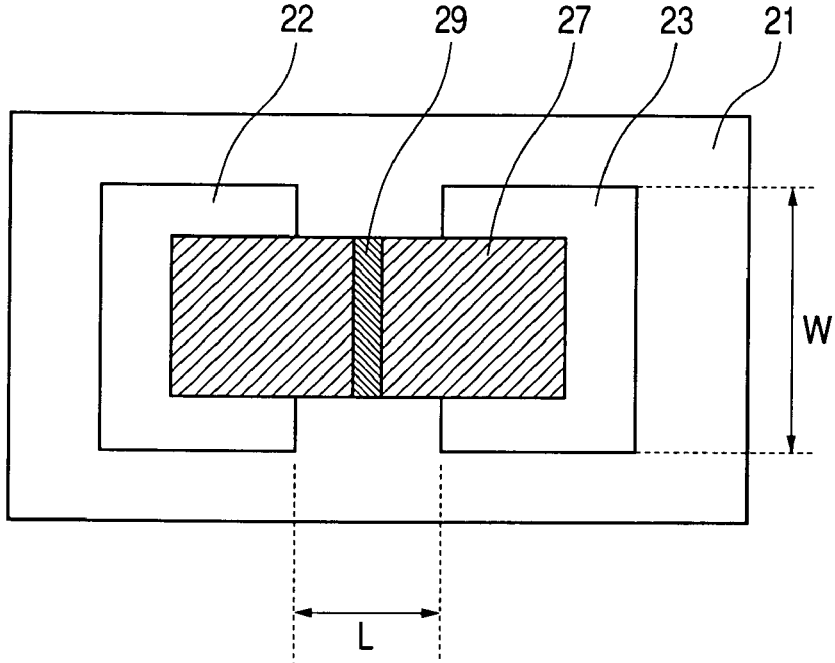
FIGS. 14A and 14B are schematic diagrams showing a structural example of a surface conduction electron-emitting device.
Figure 14B:
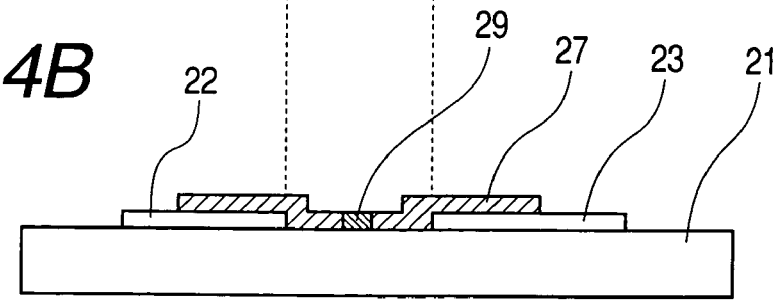

A surface conduction electron-emitting device, for example, is suitable for an electron-emitting device formed on an electron source substrate as shown in FIGS. 14A and 14B. FIG. 14A is a plan view of the surface conduction electron-emitting device and FIG. 14B is a sectional view thereof.

A substrate 21 is formed of glass and others. The size and thickness of the substrate 21 are set to suite the number of electron-emitting devices to be placed thereon, the design shape of each electron-emitting device, and if the substrate is to constitute a part of the container when the electron source is in use, an atmospheric pressure-resistant structure and other mechanical conditions for keeping the container in a vacuum state.

The glass material commonly employed is soda lime glass, which is inexpensive. The substrate is constructed to have on a soda lime glass plate a sodium block layer, for example, a silicon oxide film formed by sputtering to a thickness of about 0.5 μm. Other than soda lime glass, glass containing less sodium or a quartz substrate is employable.

Device electrodes 22 and 23 are formed from a common conductive material. For example, metals such as Ni, Cr, Au, Mo, Pt, and Ti and metal alloys such as Pd—Ag are suitable. Alternatively, an appropriate material is chosen from a printed conductor composed of a metal oxide, glass and others, a transparent conductor such as ITO, and the like. The thickness of the conductive film for the device electrodes is preferably between several hundreds Å and a few μm.

A device electrode gap L, a device electrode length W, and the shape of the device electrodes 22 and 23 are set to suite the actual application mode of the electron-emitting device. Desirably, the gap L is from several thousands angstrom to 1 mm. Considering the voltage applied between the device electrodes and other factors, a more desirable gap between the device electrodes is 1 μm to 100 μm. Taking into account the electrode resistance and the electron emission characteristic, the device electrode length W is preferably a few μm to several hundreds μm.

A commercially-available paste containing metal particles such as platinum (Pt) may be applied to the device electrodes by offset printing or other printing methods. A more precise pattern can be obtained through a process that includes application of a photosensitive paste containing platinum (Pt) or the like by screen printing or by a similar printing method, exposure to light using a photo mask, and development.

A conductive film 27, which is a thin film for forming an electron-emitting region, is formed so as to stride the device electrodes 22 and 23.

A fine particle film formed of fine particles is particularly desirable for the conductive film 27 since it can provide an excellent electron-emitting characteristic. The thickness of the conductive film 27 is set taking into consideration the step coverage for covering level differences of the device electrodes 22 and 23, the resistance between the device electrodes, forming operation conditions, which will be described later, and others. Desirably, the conductive film 27 has a thickness of a few Å to several thousands angstrom, more desirably, 10 Å to 500 Å.

In general, a suitable conductive film material is palladium (Pd) but the conductive film 27 is not limited thereto. The conductive film 27 is formed by an appropriate method such as sputtering, or baking after application of a solution.

The electron-emitting region, which is denoted by 29, can be formed by an energization operation described below, for example. Note that, although the electron-emitting region 29 is placed at the center of the conductive film 27 and has a rectangular shape in the drawings for conveniences' sake, they are a schematic expression and not the exact depiction of the position and shape of the actual electron-emitting region.

When a not-shown power supply energizes areas between the device electrodes 22 and 23 at a given vacuum level, a gap (fissure) where the structure has been altered appears in a part of the conductive film 27. The gap region constitutes the electron-emitting region 29. At a given voltage level, regions surrounding the gap that is created by the energization forming also emit electrons. However, the electron emission efficiency at this stage is very low.

Figure 8A:
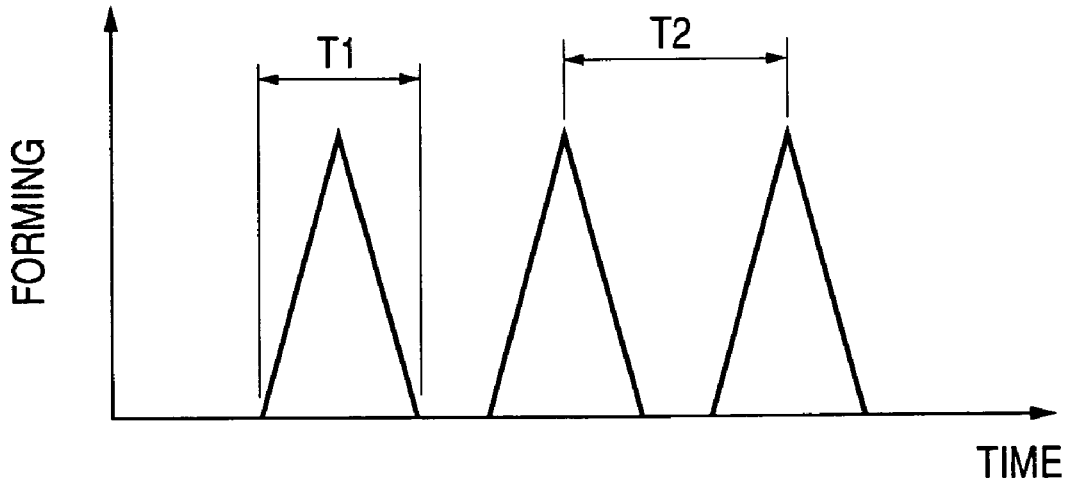
FIGS. 8A and 8B are diagrams showing examples of a forming voltage.
Figure 8B:
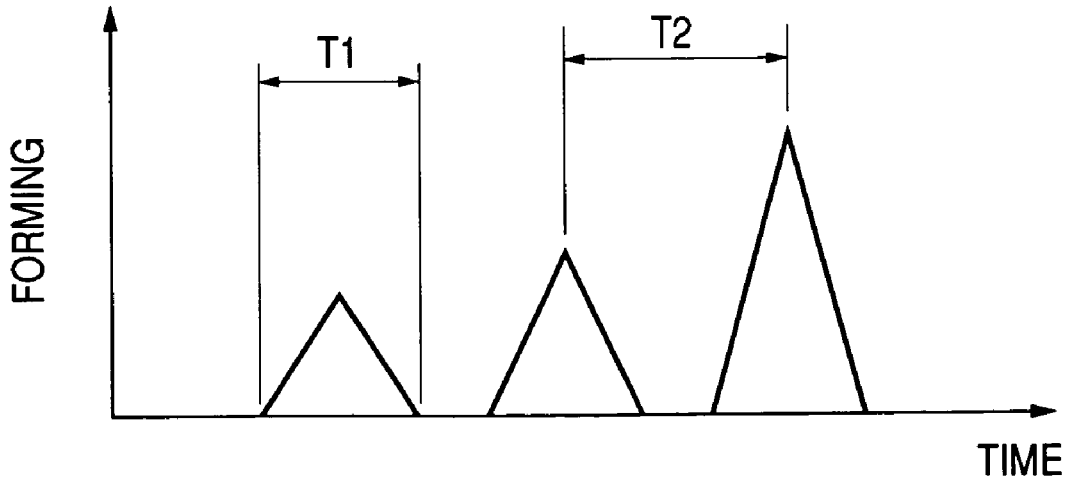

Examples of a voltage waveform in energization forming are shown in FIGS. 8A and 8B. A particularly desirable voltage waveform is a pulse waveform. There are two methods to obtain a pulse waveform. One is to continuously apply pulses with the pulse wave height set to a constant voltage, and is shown in FIG. 8A. The other is to apply pulses while raising the pulse wave height in increments, and is shown in FIG. 8B.

Referring to FIG. 8A, a case where the pulse wave height has a constant voltage is described first. T1 and T2 in FIG. 8A represent the pulse width and pulse interval of the voltage waveform, respectively. Usually, T1 is set to 1 μsec to 10 msec and T2 is set to 10 μsec to 100 msec. The wave height of the A-frame wave (the peak voltage in energization forming) is chosen to suite the mode of the electron-emitting device. Under these conditions, the voltage is applied for, for example, a few seconds to several tens minutes. The pulse waveform employed is not limited to A-frame wave but can be square wave or other desired waveforms.

A case where voltage pulses are applied while raising the pulse wave height in increments is described next referring to FIG. 8B. T1 and T2 in FIG. 8B are identical to T1 and T2 in FIG. 8A, respectively. The wave height of the A-frame wave (the peak voltage in energization forming) is increased in, for example, 0.1-V steps.

The current flowing in the electron-emitting device while the pulse voltage is applied is measured to obtain the resistance. When the resistance reaches, for example, 1 MΩ or higher, it is time to end the energization forming operation.

The electron emission efficiency after the forming operation is finished is very low. In order to raise the electron emission efficiency, the electron-emitting device is desirably subjected to treatment called an activation operation.

The activation operation includes applying a pulse voltage repeatedly between the device electrodes 22 and 23 at an appropriate vacuum level in the presence of an organic compound. Then, gas containing carbon atoms is introduced to deposit carbon or a carbon compound originated from the gas in the vicinity of the gap (fissure) and to form it into a carbon film.

To give an example of this step, tolunitrile is employed as a carbon source, gas is introduced through a slow leak valve into a vacuum space, and the pressure is maintained at $1.3\times10^{-4}$ Pa or so. Although the pressure of tolunitrile introduced is slightly influenced by the shape of the vacuum device, members used in the vacuum device, and the like, it is preferably $1\times10^{-5}$ Pa to $1\times10^{-2}$ Pa.

Figure 9A:
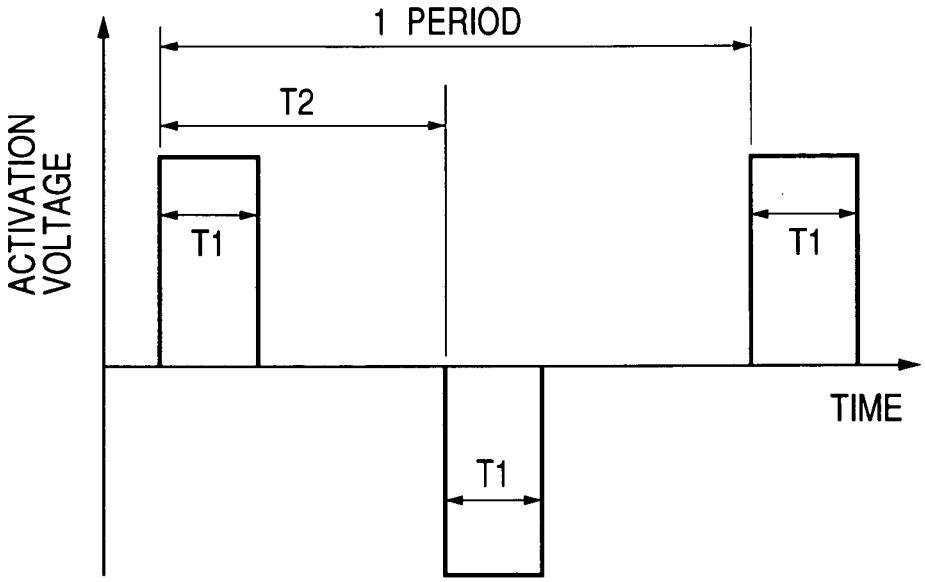
FIGS. 9A and 9B are diagrams showing examples of an activation voltage.
Figure 9B:
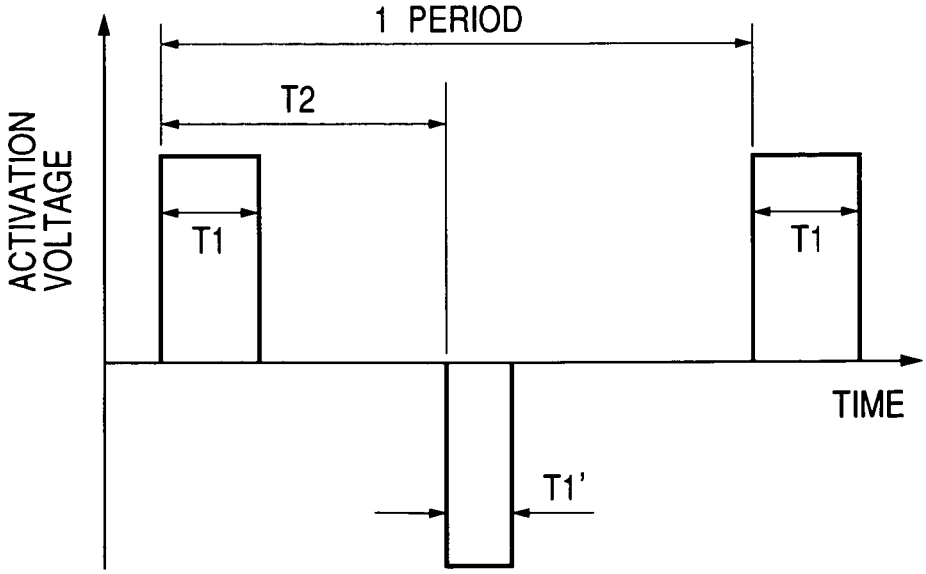

FIGS. 9A and 9B show preferred examples of voltage application employed in the activation step. The maximum voltage value applied is appropriately chosen from between 10 V and 20 V.

In FIG. 9A, T1 represents the pulse width of positive and negative pulses of the voltage waveform whereas T2 represents the pulse interval. The voltage values of a positive pulse and a negative pulse are set to have the same absolute value. In FIG. 9B, T1 and T' represent the pulse width of a positive pulse and the pulse width of a negative pulse of the voltage waveform, respectively, whereas T2 represents the pulse interval. T1 is set larger than T1'. The voltage values of a positive pulse and a negative pulse are set to have the same absolute value.

The energization is stopped as an emission current Ie reaches near saturation, and then the slow leak valve is closed to end the activation operation.

Obtained through the above steps is the electron-emitting device shown in FIGS. 14A and 14B.

The description given next is about an electron source substrate and image display device according to the present invention.

Figure 2:
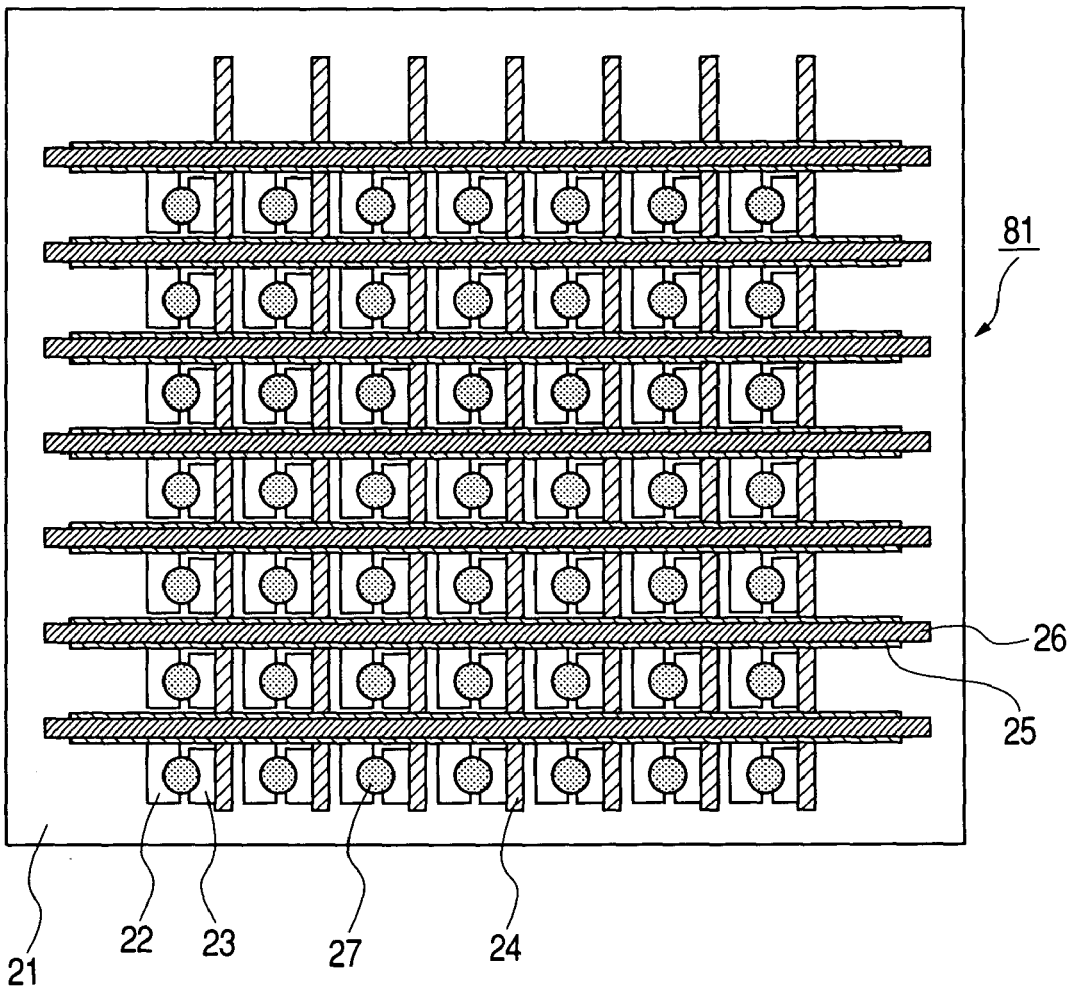
FIG. 2 is a plan view schematically showing a structural example of an electron source substrate that is applicable to an image display device of the present invention.
Figure 3:
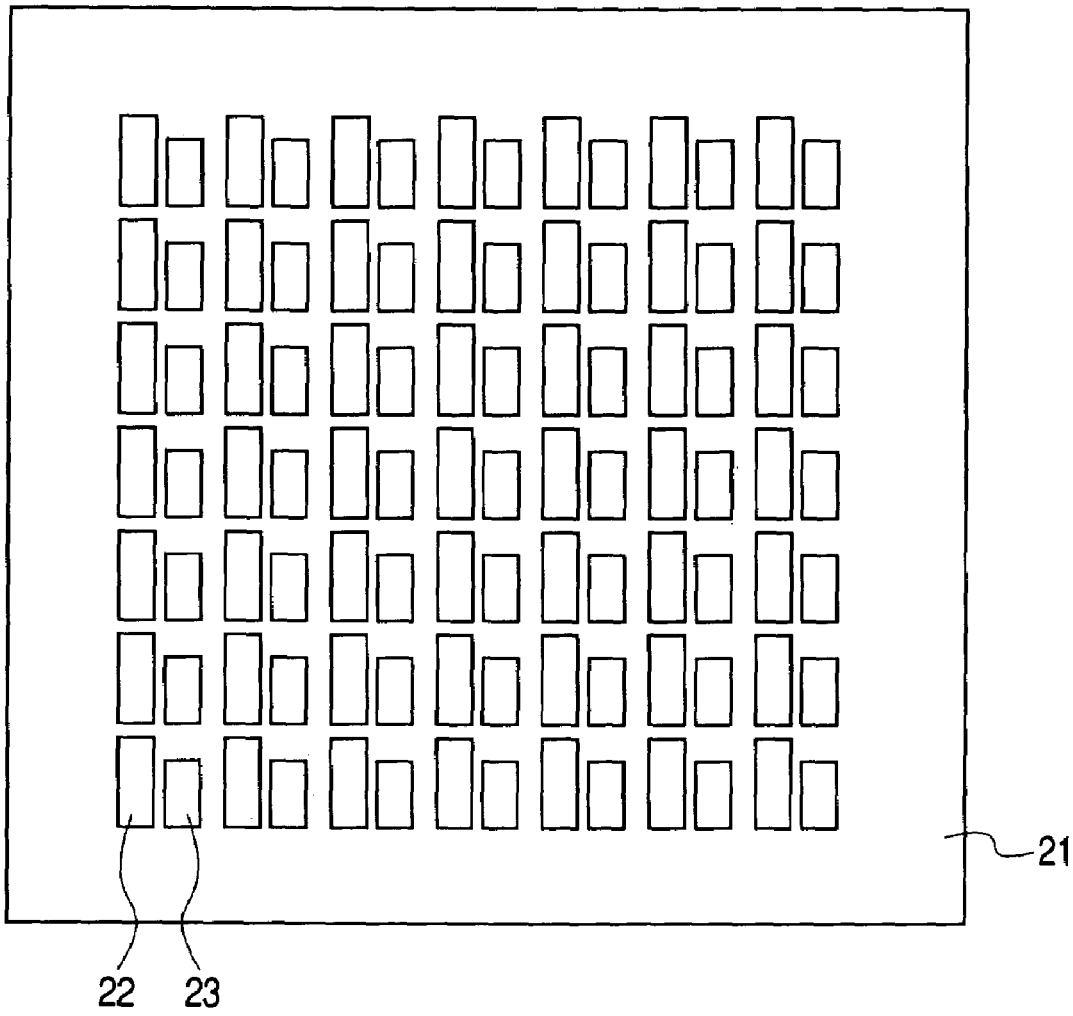
FIG. 3 is a diagram illustrating a process of manufacturing the electron source substrate of FIG. 2.
Figure 4:
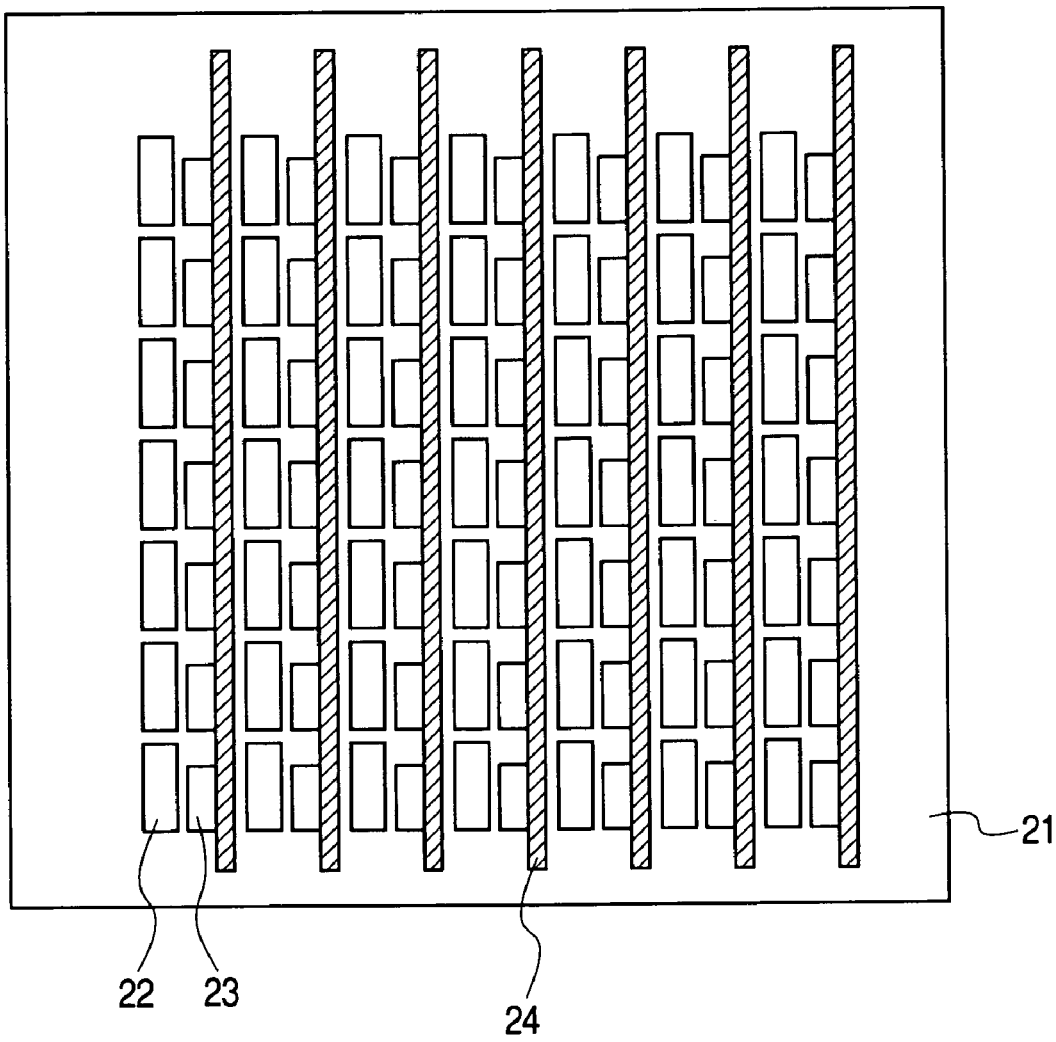
FIG. 4 is a diagram illustrating a process of manufacturing the electron source substrate of FIG. 2.
Figure 5:
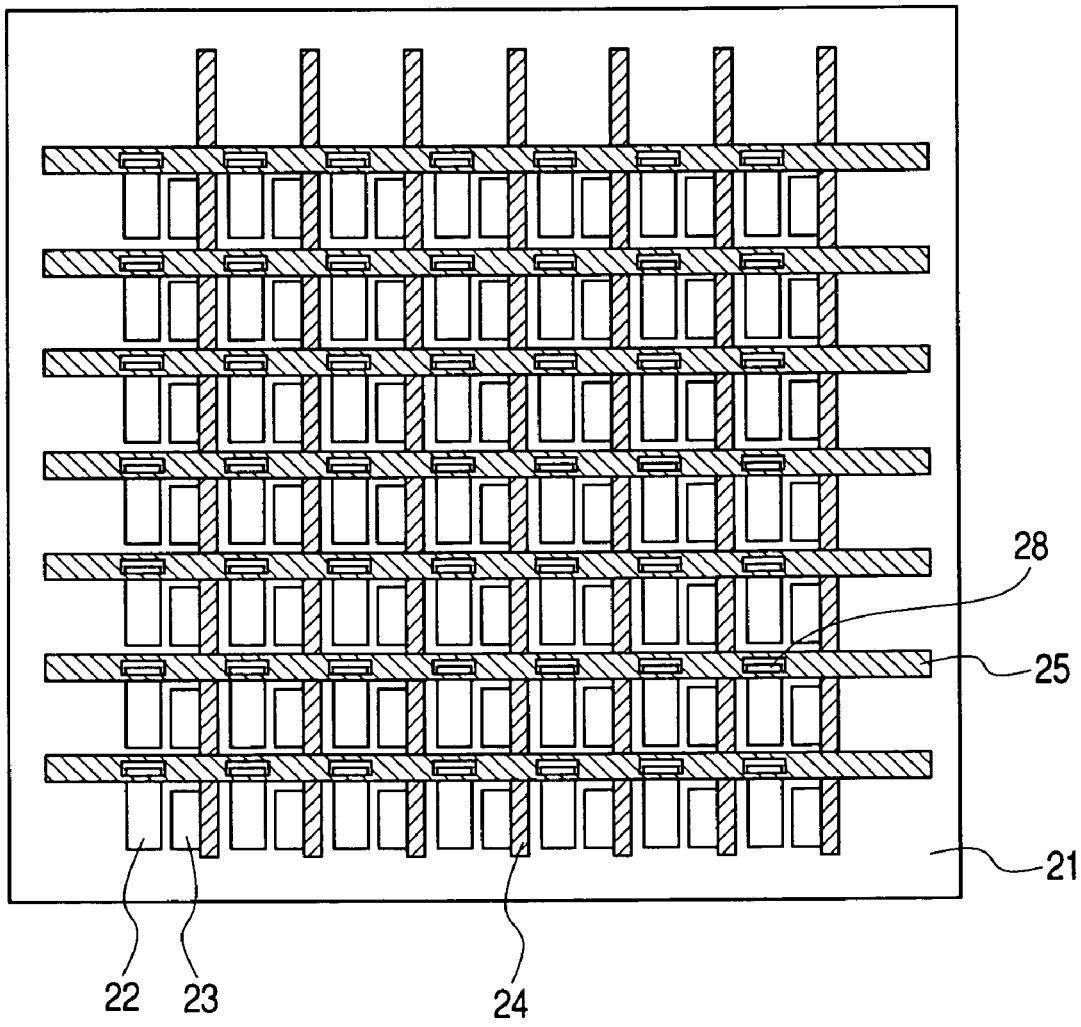
FIG. 5 is a diagram illustrating a process of manufacturing the electron source substrate of FIG. 2.
Figure 6:
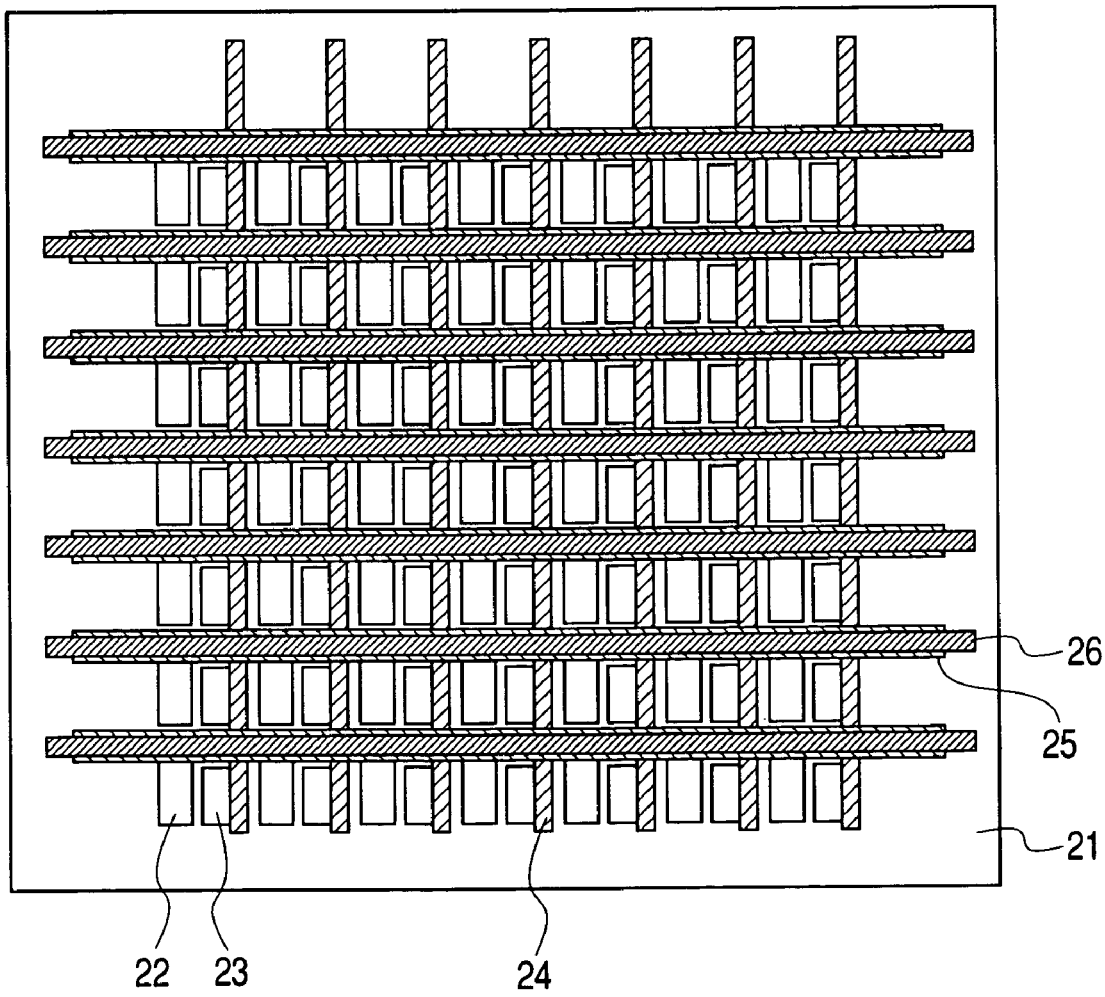
FIG. 6 is a diagram illustrating a process of manufacturing the electron source substrate of FIG. 2.

The basic structure of an electron source substrate according to the present invention is shown in FIG. 2.

This electron source substrate has a plurality of X direction wirings (scanning signal wiring) 26 on a substrate 21. On the X direction wirings 26, an interlayer insulating film 25 is placed and then a plurality of Y direction wirings (modulation signal wiring) 24 are formed. An electron-emitting device as the one shown in FIGS. 14A and 14B is arranged in the vicinity of each intersection point where the X direction wirings and the Y direction wirings intersect each other.

The X direction wirings 26 act as scanning electrodes after the electron source substrate is made into a panel as an image display device. The scanning electrodes are required to have a wiring resistance lower than that of the Y direction wirings 24, which act as modulation signal electrodes. Therefore, the X direction wirings 26 are designed to be either wide or thick. In other words, the line width of the X direction wirings (scanning signal wiring) 26 can be wider than that of the Y direction wirings (modulation signal wiring) 24.

Note that the interlayer insulating film 25 can be formed by photo process or screen printing, or by a combination of photo process and screen printing.

Figure 1B:
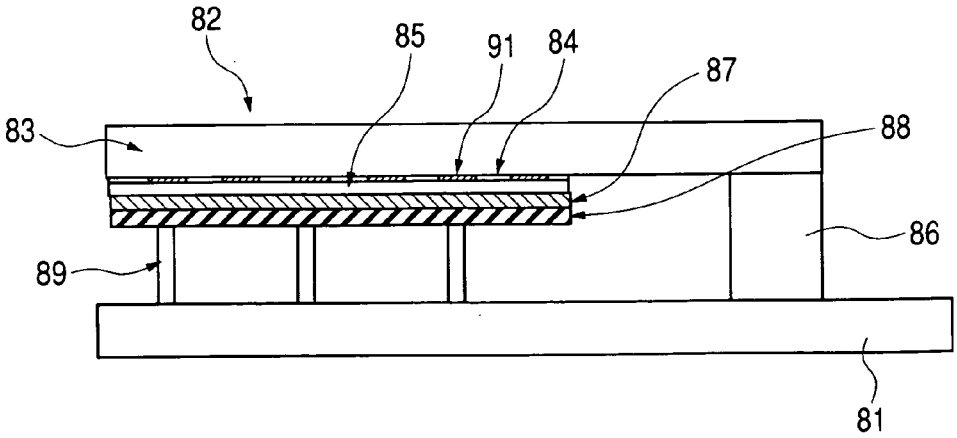

FIGS. 1A and 1B show an example of an image display device of the present invention which uses the above passive matrix electron source substrate. FIG. 1A is an overall perspective view schematically showing the image display device. In FIG. 1A, a supporting frame 86 and a face plate 82, which will be described later, are partially cut off in order to illustrate the internal structure of an airtight container 90. FIG. 1B is a partial sectional view taken along the line 1B—1B of FIG. 1A.

Denoted by 81 in FIGS. 1A and 1B is an electron source substrate on which a plurality of electron-emitting devices are arranged to have the structure shown in FIG. 2 and which serve as a rear plate.

The face plate 82 is obtained by forming, on a glass substrate 83, a fluorescent film 84, a metal back 85, a non-evaporating getter 87, and an evaporating getter 88. The fluorescent film 84 serves as an image display member. The face plate 82 constitutes the image display region.

Figure 10A:
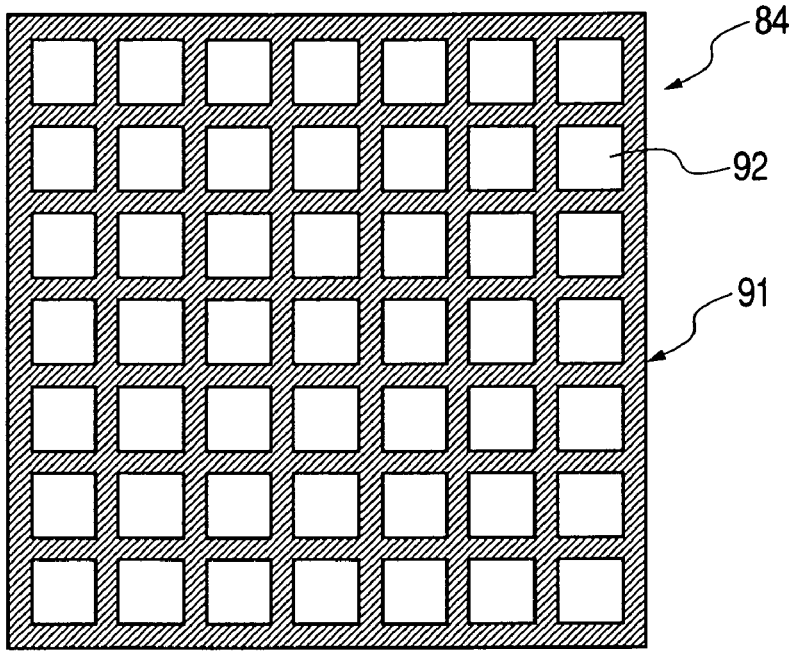
FIGS. 10A and 10B are diagrams schematically showing examples of a fluorescent film in an image display device according to the present invention.
Figure 10B:
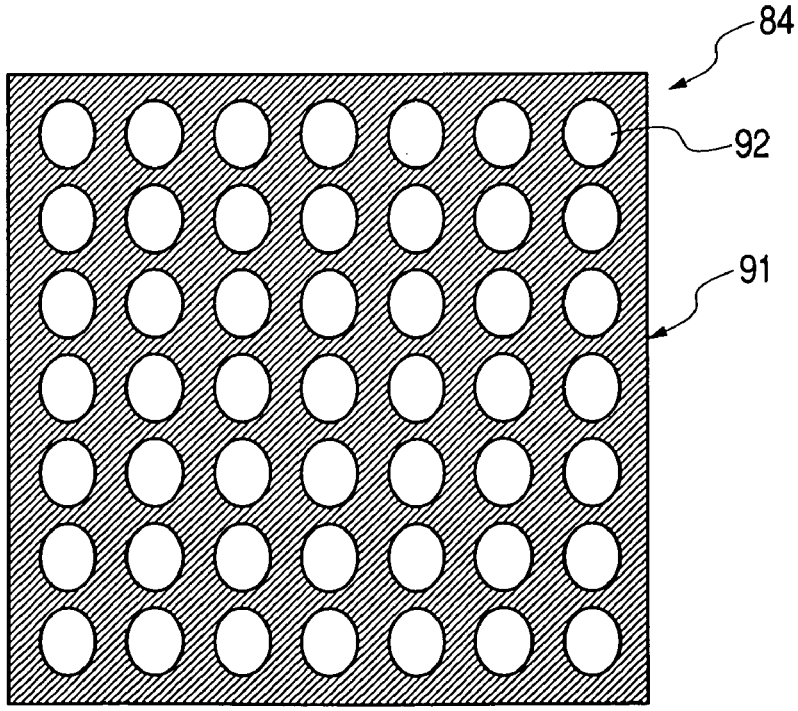

FIGS. 10A and 10B are explanatory diagrams of the fluorescent film 84, which is to be placed on the face plate 82. The fluorescent film 84 consists solely of phosphors if it is a monochromatic film. If the fluorescent film 84 is a color fluorescent film, it consists of black conductors 91 and phosphors 92. The black conductors 91 are called a black stripe or a black matrix depending on the arrangement of the phosphors. The black stripe, or the black matrix is provided in order to make mixed colors or the like inconspicuous by painting gaps between phosphors 92 of three different primary colors, which are necessary in color image display, black. The black stripe or the black matrix also helps to prevent external light from being reflected at the fluorescent film 84 and lowering the contrast.

The metal back 85 is usually placed on the inner side of the fluorescent film 84. The metal back is provided in order to improve the luminance by redirecting inward light out of light emitted from the phosphors toward the face plate 82 through specular reflection. Another purpose of the metal back 85 is as an anode electrode to which an electron beam acceleration voltage is applied. The metal back is formed by smoothening the inner surface of the fluorescent film (the smoothening treatment is usually called filming) after manufacturing the fluorescent film and then depositing Al through vacuum evaporation or the like.

The non-evaporating getter 87 and the evaporating getter 88 are layered on the face plate.

The electron source substrate 81, the supporting frame 86, and the face plate 82 are bonded to one another using flit glass or the like to constitute the airtight container 90. Supporting bodies 89 called spacers are set between the face plate 82 and the electron source substrate 81 to give the airtight container 90 enough strength against the atmospheric pressure even when the display device is a large-area panel.

Next, a description is given on a method of manufacturing an image display device of the present invention which has the above structure.

First, the non-evaporating getter 87 is placed at a given position on the face plate 82. Preferably, the non-evaporating getter 87 is formed on the metal back 85 and on the black conductors 91, which are interspersed in the fluorescent film 84, throughout the entire image display region uniformly.

Specifically, the non-evaporating getter 87 is obtained by forming first a film of uniform thickness all over the image display region using a mask that has a large window sized to the image display region and then removing unnecessary portions. Another example of how to obtain the non-evaporating getter 87 is to form films on the black conductors 91 using an appropriate mask that has openings patterned after the pattern of the black conductors 91. In either case, the non-evaporating getter 87 can readily be formed by vacuum evaporation or sputtering.

A preferred material of the non-evaporating getter 87 is one mainly containing Ti. The metal Ti is larger in atomic mass than Al and therefore is inferior to Al in terms of electron beam transmittancy. This makes it necessary to form the Ti getter 87 thinner than the metal back 85, which is formed on the fluorescent film 84 and which is a single Al thin film. Therefore, the thickness of the Ti getter 87 is desirably set to 300 Å to 1000 Å.

The next step is to set, under a vacuum atmosphere, the electron source substrate 81 shown in FIG. 2, the face plate 82 on which the non-evaporating getter 87 is placed, and the supporting frame 86 (the set step). The vacuum level at this point is preferably $10^{-4}$ Pa or less.

Subsequently, the electron source substrate 81, the face plate 82 on which the non-evaporating getter 87 is placed, and the supporting frame 86 are baked in a vacuum atmosphere (the baking step). The baking step is preferably heat treatment performed at a temperature of 250° C. or higher and 450° C. or lower. This way the baking step can double as a step for activating the non-evaporating getter.

Then, the evaporating getter 88 is formed on the non-evaporating getter 87 by flashing. The main component of the evaporating getter 88 is usually Ba. The evaporation film maintains the vacuum level by its adsorption effect.

An example of a specific method to form the evaporating getter 88 is flashing of a getter material that has been made into a ribbon adaptable to induction heating. The temperature in forming the evaporating getter 88 is preferably 250° C. or lower. If the temperature is too high, the pump function (gas adsorption function) of the evaporating getter is reduced.

In the present invention, the evaporating getter 88 is preferably thinner than the non-evaporating getter 87. A too thick evaporating getter lowers the pump function (gas adsorption function) of the underlying non-evaporating getter.

The non-evaporating getter 87 has an effect of quickly adsorbing gas in flashing of the evaporating getter 88 to thereby prevent degradation of the evaporating getter 88 and increase the total amount of gas adsorbed by the entire evaporating getter. Forming the non-evaporating getter 87 and the evaporating getter 88 thin on the metal back 85 provides an effect of increasing the total area of the non-evaporating getter and the evaporating getter without impairing the transmittancy of an electron entering the fluorescent film 84.

Next, the electron source substrate 81, the supporting frame 86, and the face plate 82 are bonded by a bonding member such as flit glass, and baked at 400° C. to 500° C. for 10 minutes or longer, for example, for sealing to obtain the airtight container 90 (the sealing step). Note that the use of In as the bonding member makes low temperature bonding process possible.

If a color image is to be displayed, phosphors of different colors have to coincide with the electron-emitting devices and careful positioning is necessary in the sealing.

Thus manufactured is the image display device (the airtight container 90) shown in FIGS. 1A and 1B.

Hereinafter a description is given on a method of manufacturing an image display device of the present invention which differs from the one described above.

In the present invention, a non-evaporating getter and an evaporating getter are stacked on an image display member having a fluorescent film in a vacuum atmosphere, at least without exposing the getters to the air.

Figure 15:
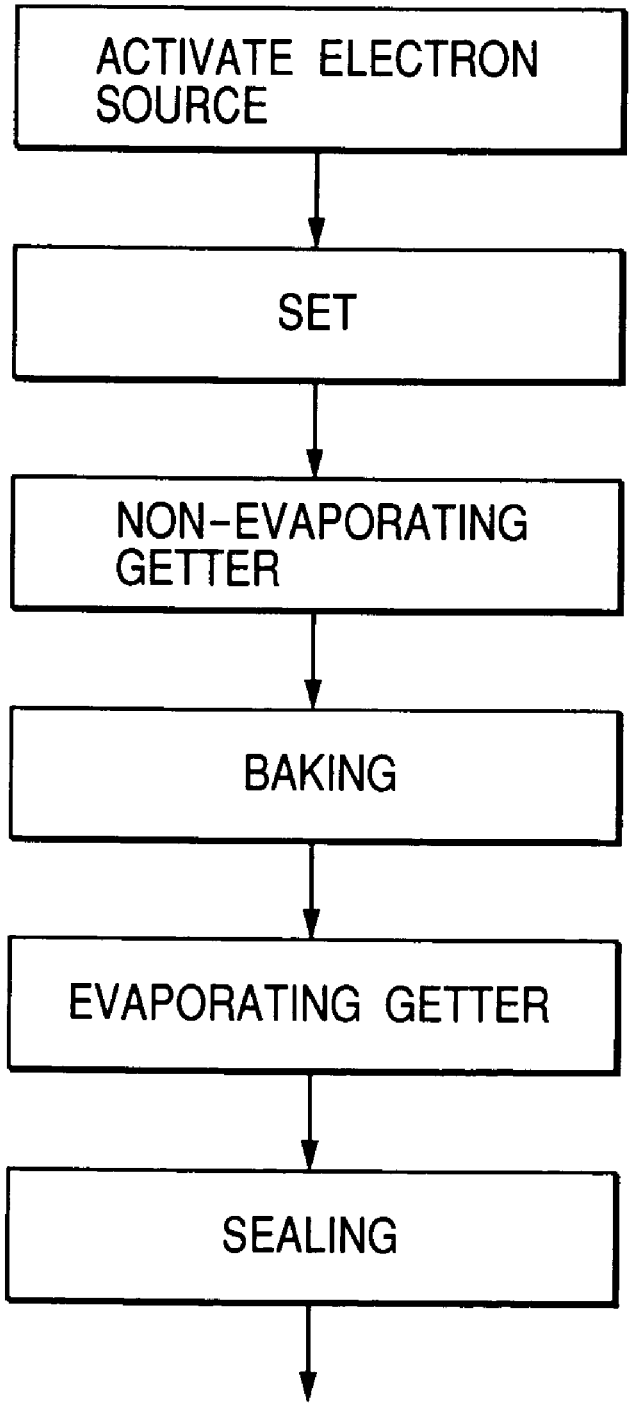
FIG. 15 is a process step flow chart illustrating an example of a method of manufacturing an image display device in accordance with the present invention.

An example of a method of manufacturing an image display device of the present invention is described with reference to a process step flow chart of FIG. 15.

First, the above-described steps up through the activation step are performed on the electron source substrate 81 shown in FIG. 2.

Next, the electron source substrate 81, the face plate 82 on which the fluorescent film 84 and the metal back 85 are formed, and the supporting frame 86 are set under a vacuum atmosphere (the set step). The vacuum level at this point is preferably $10^{-4}$ Pa or less.

Then, the non-evaporating getter 87 is placed at a given position on the face plate 82 (the non-evaporating getter step). Preferably, the non-evaporating getter 87 is formed on the metal back 85 and on the black conductors 91, which are interspersed in the fluorescent film 84, throughout the entire image display region uniformly.

Specifically, the non-evaporating getter 87 is obtained by forming first a film of uniform thickness all over the image display region using a mask that has a large window sized to the image display region and then removing unnecessary portions. Another example of how to obtain the non-evaporating getter 87 is to form films on the black conductors 91 using an appropriate mask that has openings patterned after the pattern of the black conductors 91. In either case, the non-evaporating getter 87 can readily be formed by vacuum evaporation or sputtering.

A preferred material of the non-evaporating getter 87 is one mainly containing Ti. The metal Ti is larger in atomic mass than Al and therefore is inferior to Al in terms of electron beam transmittancy. This makes it necessary to form the Ti getter 87 thinner than the metal back 85, which is formed on the fluorescent film 84 and which is a single Al thin film. Therefore, the thickness of the Ti getter 87 is desirably set to 300 Å to 1000 Å.

Subsequently, the electron source substrate 81, the face plate 82 on which the non-evaporating getter 87 is placed, and the supporting frame 86 are baked in a vacuum atmosphere (the baking step). The temperature in the baking step is preferably set to 250° C. or higher and 400° C. or lower.

Then, the evaporating getter 88 is formed on the non-evaporating getter 87 by flashing (the evaporating getter step). The evaporating getter step could be put before the baking step, but preferably is put after the baking step. If the evaporating getter step precedes the baking step, gas generated in the baking step can lower the gas adsorption function of the evaporating getter.

The main component of the evaporating getter 88 is usually Ba. The evaporation film maintains the vacuum level by its adsorption effect. An example of a specific method to form the evaporating getter 88 is flashing of a getter material that has been made into a ribbon adaptable to induction heating. The temperature in forming the evaporating getter 88 is preferably 250° C. or lower. If the temperature is too high, the pump function (gas adsorption function) of the evaporating getter can be reduced.

In the evaporating getter step, the non-evaporating getter 87 has an effect of quickly adsorbing gas in flashing of the evaporating getter 88 to thereby prevent degradation of the evaporating getter 88 and increase the total amount of gas adsorbed by the entire evaporating getter. Forming the non-evaporating getter 87 and the evaporating getter 88 thin on the metal back 85 provides an effect of increasing the total area of the non-evaporating getter and the evaporating getter without impairing the transmittancy of an electron entering the fluorescent film 84.

Next, the electron source substrate 81, the supporting frame 86, and the face plate 82 are bonded by a bonding member such as flit glass, and baked at 400° C. to 500° C. for 10 minutes or longer, for example, for sealing to obtain the airtight container 90 (the sealing step). Note that the use of In as the bonding member makes low temperature bonding process possible.

If a color image is to be displayed, phosphors of different colors have to coincide with the electron-emitting devices and careful positioning is necessary in the sealing.

The above example deals with the case of putting the non-evaporating getter step before the baking step. However, the baking step may precede the non-evaporating getter step and the evaporating getter step. Also, the non-evaporating getter step and the evaporating getter step may exchange their places in the process order. In the case where the evaporating getter step comes before the non-evaporating getter step, it is desirable to form the non-evaporating getter on the evaporating getter immediately after the evaporating getter step. This way gas generated by flashing of the evaporating getter can quickly be adsorbed by the non-evaporating getter and is prevented from lowering the pump function of the evaporating getter.

Thus manufactured is the image display device (the airtight container 90) shown in FIGS. 1A and 1B.

Now, embodiments of the present invention will be described. Note that the present invention is not limited to these embodiments.

EMBODIMENT 1

This embodiment describes an example of manufacturing an image display device as the one shown in FIGS. 1A and 1B from an electron source substrate as the one shown in FIG. 2 which has a large number of surface conduction electron-emitting devices connected in accordance with matrix wiring.

First, an electron source substrate manufacturing method according to this embodiment is described with reference to FIGS. 2, 3, 4, 5, 6, 7A, 7B and 7C.

(Formation of Device Electrodes)

This embodiment uses as the material of a substrate 21 electric glass for plasma displays which is reduced in alkaline content, specifically, PD-200, a product of Asahi Glass Co., Ltd. On the glass substrate 21, a titanium (Ti) film with a thickness of 5 nm is formed first by sputtering and then a platinum (Pt) film with a thickness of 40 nm, thereby obtaining an underlayer. Then photo resist is applied, followed by a series of photolithography processes including exposure to light, development, and etching. Through this patterning, device electrodes 22 and 23 are obtained (See FIG. 3). In this embodiment, a device electrode gap L is set to 10 μm and a device electrode length W (the distance the device electrodes 22 and 23 run facing each other) is set to 100 μm.

(Formation of Y Direction Wirings)

X direction wirings 26 and Y direction wirings 24 are desirably low-resistant so that a large number of surface conduction electron-emitting devices can receive mostly equal voltage. Materials, thicknesses, and widths that can lower the wire resistance are chosen for the wirings 26 and 24.

The Y direction wirings (lower wirings) 24 as common wirings form a line pattern that brings the wirings 24 into contact with either the device electrodes 23 or the device electrodes 24 (23, in this embodiment) and links those device electrodes to one another. The material used for the wirings 24 is silver (Ag) photo paste ink, which is applied by screen printing, let dry, and then exposed to light and developed into a given pattern. Baking at a temperature around 480° C. is the last step before the Y direction wirings 24 are completed (See FIG. 4). The Y direction wirings 24 each have a thickness of about 10 μm and a width of about 50 μm. Though not shown in the drawing, the wirings 24 become wider toward their ends so that the ends can be used as wire lead-out electrodes.

(Formation of an Interlayer Insulating Film)

An interlayer insulating film 25 is placed in order to insulate the lower wirings from upper wirings. The interlayer insulating film 25 covers intersection points between the X direction wirings (upper wirings) 26, which will be described later, and the previously-formed Y direction wirings (lower wirings) 24. In the interlayer insulating film 25, contact holes 28 are opened at points where the X direction wirings (upper wirings) 26 are in contact with the device electrodes that are not connected to the Y direction wirings 24 (in this embodiment, the device electrodes 22), thereby allowing the wirings 26 and the device electrodes to form electric connection (See FIG. 5).

Specifically, a photosensitive glass paste mainly containing PbO is applied by screen printing and then exposed to light and developed. This is repeated four times and lastly the coats are baked at a temperature around 480° C. The interlayer insulating film 25 has a thickness of about 30 μm in total and a width of about 150 μm.

(Formation of X Direction Wirings)

To form the X direction wirings (upper wirings) 26, Ag paste ink is printed onto the previously-formed interlayer insulating film 25 by screen printing and let dry. The printing and drying is repeated to form two coats, which are then baked at a temperature around 480° C. The X direction wirings 26 intersect the Y direction wirings 24 sandwiching the interlayer insulating film 25 between them. The X direction wirings 26 are connected, in the contact holes of the interlayer insulating film 25, to the device electrodes that are not connected to the Y direction wirings 24 (in this embodiment, the device electrodes 22) (See FIG. 6). Each of the X direction wirings 26 has a thickness of about 15 μm, and becomes wider toward its ends so that the ends can be used as wire lead-out electrodes.

A substrate having XY matrix wiring is thus obtained.

(Formation of a Conductive Film)

Next, the above substrate is thoroughly cleaned and the surface is treated with a solution containing a water repellent agent to make the surface hydrophobic. This is to apply, in a subsequent step, an aqueous solution for forming a conductive film to the top faces of the device electrodes and spread it properly. The water repellent agent employed is a DDS (dimethyl diethoxy silane) solution, which is sprayed onto the substrate and dried by hot air at 120° C.

Thereafter, the conductive film 27 is formed between the device electrodes by ink jet application. This step is explained referring to the schematic diagrams of FIGS. 7A, 7B and 7C. In order to compensate the fluctuation in plane among device electrodes on the substrate 21, the material for forming the conductive film is applied with precision at corresponding positions. This is achieved by measuring misalignment of the pattern at several points on the substrate and calculating linear approximation of the misalignment amount between measurement points for positional supplementation. Thus misalignment is adjusted for every pixel.

Figure 7A:
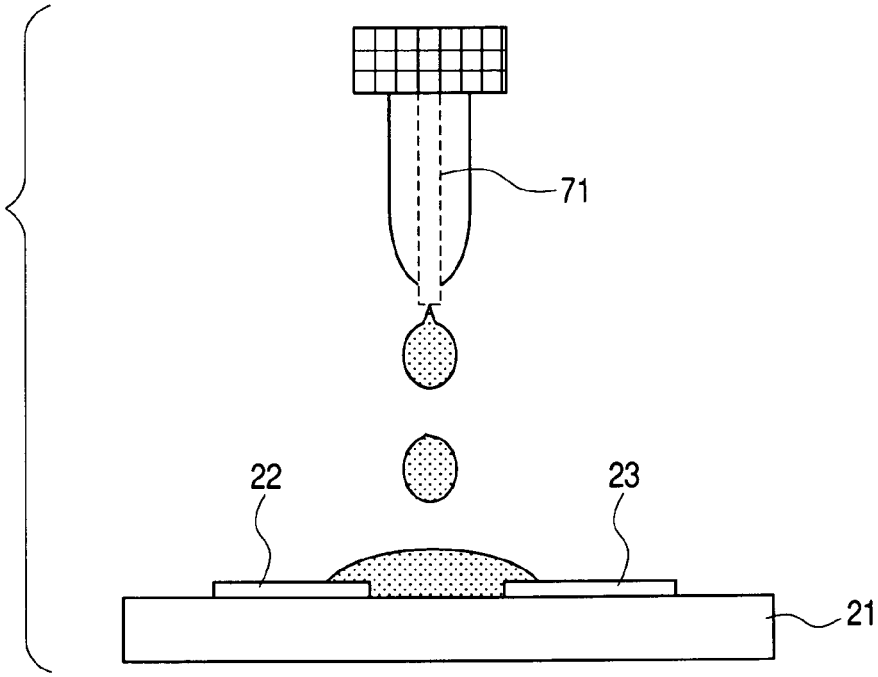
FIGS. 7A, 7B, and 7C are diagrams illustrating a process of manufacturing the electron source substrate of FIG. 2.

The conductive film 27 in this embodiment is a palladium film. First, 0.15 wt % of palladium-proline complex is dissolved in an aqueous solution containing water and isopropyl alcohol (IPA) at a ratio of 85:15 to obtain an organic palladium-containing solution. A few additives are added to the solution. A drop of this solution is ejected from dripping means 71, specifically, an ink jet device with a piezoelectric element, and lands between the electrodes after an adjustment is made to set the dot diameter to 60 μm (FIG. 7A).

Figure 7B:
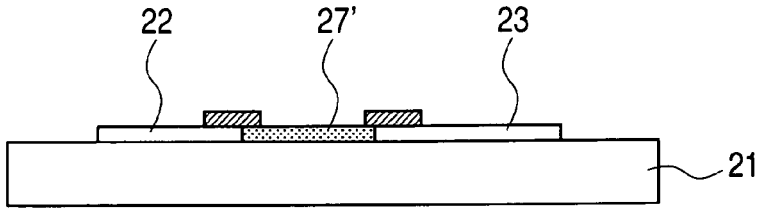

The substrate is then subjected to heat and bake processing in the air at 350° C. for 10 minutes to form a palladium oxide (PdO) film as a conductive film 27' (FIG. 7B). The film obtained has a dot diameter of about 60 μm and a thickness of 10 nm at maximum.

(Forming Step)

Figure 7C:
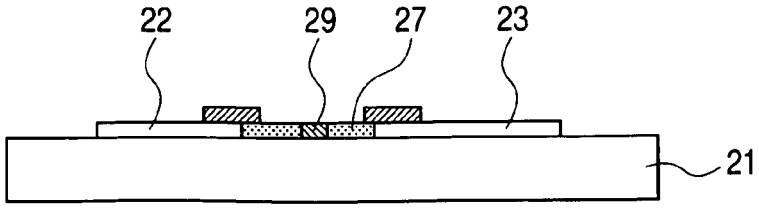

In the next step called forming, the above conductive film 27' is subjected to an energization operation to create a fissure within as an electron-emitting region 29 (FIG. 7C).

Specifically, the electron-emitting region 29 is obtained as follows:

A vacuum space is created between the substrate 21 and a hood-like cover, which covers the entire substrate except the lead-out wire portions on the perimeter of the substrate 21. Through terminals of the lead-out wires, an external power supply applies a voltage between the X and Y direction wirings 24 and 26. Areas between the device electrodes 22 and 23 are thus energized to locally damage, deform, or modify the conductive film 27'. The resultant electron-emitting region 29 is highly electrically resistant.

If the energization heating is conducted in a vacuum atmosphere that contains a small amount of hydrogen gas, hydrogen accelerates reduction and the conductive film 27', which is a palladium oxide film (PdO), is changed into the conductive film 27, which is a palladium (Pd) film.

During this change, the film shrinks from the reduction and a fissure (gap) is formed in a part of the film. The position and shape of the fissure are greatly influenced by the homogeneity of the original film. In order to prevent fluctuation in characteristic among a large number of electron-emitting devices, the above fissure is most desirably formed at the center of the conductive film 27 and is as linear as possible.

At a given voltage, electrons are also emitted from regions surrounding the fissure that has been created by the forming. However, the emission efficiency is very low under the present condition.

A resistance Rs of the obtained conductive film 27 is from $10^2$ Ω to $10^7$ Ω.

The forming operation in this embodiment uses the pulse waveform shown in FIG. 8B, with T1 set to 0.1 msec and T2 to 50 msec. The voltage applied is initially 0.1 V and then increased every five seconds in 0.1-V steps. The current flowing in the electron-emitting devices while the pulse voltage is applied is measured to obtain the resistance and, when the resistance reaches a level 1000 times the resistance of before the forming operation, or a higher level, the energization forming operation is ended.

(Activation Step)

Similar to the forming described above, a vacuum space is created between the substrate 21 and a hood-like cover and, through the X and Y direction wirings 24 and 26, a pulse voltage is applied from the outside repeatedly to areas between the device electrodes 22 and 23. Then gas containing carbon atoms is introduced and a carbon film is formed by depositing carbon or a carbon compound that is originated from the gas in the vicinity of the fissure.

In this embodiment, tolunitrile is employed as a carbon source, the gas is introduced through a slow leak valve into the vacuum space, and the pressure is maintained at $1.3\times10^{-4}$ Pa.

FIGS. 9A and 9B show preferred examples of voltage application employed in the activation step. The maximum voltage value applied is appropriately chosen from 10 V to 20 V.

In FIG. 9A, T1 represents the pulse width of positive and negative pulses of the voltage waveform whereas T2 represents the pulse interval. The voltage values of a positive pulse and a negative pulse are set to have the same absolute value. In FIG. 9B, T1 and T1' represent the pulse width of a positive pulse and the pulse width of a negative pulse of the voltage waveform, respectively, whereas T2 represents the pulse interval. T1 is set larger than T1'. The voltage values of a positive pulse and a negative pulse are set to have the same absolute value.

In the activation step, the voltage applied to the device electrodes 23 is the positive voltage. When a device current If flows from the device electrodes 23 to the device electrodes 22, it is the positive direction. The energization is stopped after about 60 minutes, at which point an emission current Ie reaches near saturation. Then the slow leak valve is closed to end the activation operation.

Obtained through the above manufacturing steps is an electron source substrate which is a substrate having thereon a large number of electron-emitting devices connected in accordance with matrix wiring.

(Characteristic Evaluation of the Electron Source Substrate)

Measurement is made on the basic characteristics of electron-emitting devices which are manufactured by the above manufacturing method to have the device structure described above. The emission current Ie measured when the voltage applied between the device electrodes is 12 V is 0.6 μA on average, and the electron emission efficiency is 0.15% on average. The electron-emitting devices also have excellent homogeneity and the Ie fluctuation among the electron-emitting devices is merely 5%.

From the passive matrix electron source substrate obtained as above, an image display device (display panel) as the one shown in FIGS. 1A and 1B is manufactured. In FIG. 1A, the image display device is partially cut off in order to show the interior.

An electron source substrate 81 and a face plate 82 are both formed from electric glass for plasma displays which is reduced in alkaline content, specifically, PD-200, a product of Asahi Glass Co., Ltd. This glass material is free from the glass coloring phenomenon and, if formed into a 3 mm thick plate, provides enough blocking effect to prevent leakage of secondarily-generated soft X rays even when the display device is driven at an acceleration voltage of 10 kV or more.

Figure 11:
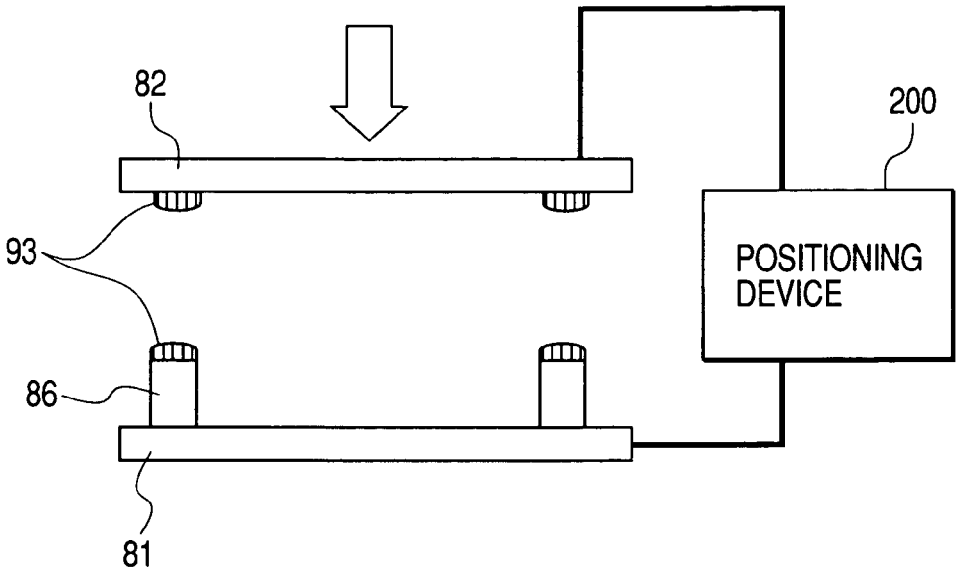
FIG. 11 is a diagram illustrating a process of manufacturing an image display device according to the present invention.
Figure 12A:
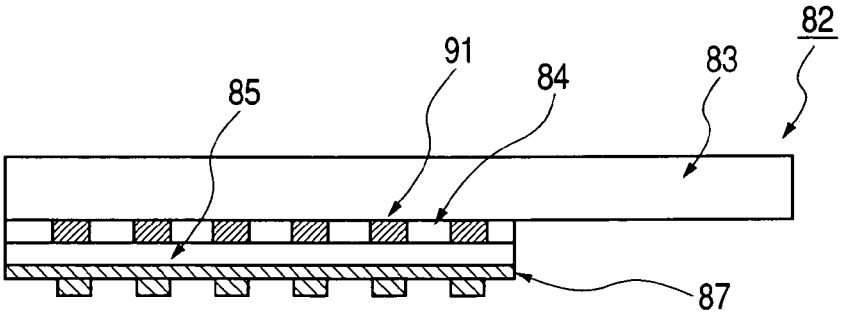
FIGS. 12A and 12B are diagrams illustrating a process of forming a non-evaporating getter and an evaporating getter on an image display member in Embodiment 1.
Figure 12B:
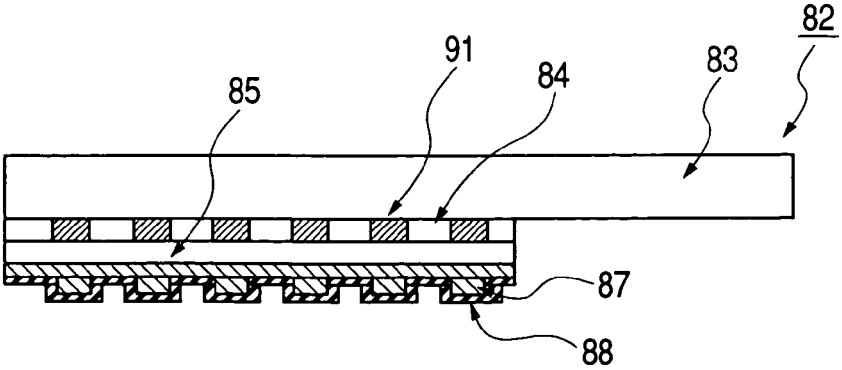

Referring to FIG. 11 and FIGS. 12A and 12B, a description is given on how to form getters and seal the image display device in accordance with this embodiment. FIGS. 12A and 12B outline the sectional structure of the periphery of the face plate.

(Placement of Bonding Members)

First, members for bonding the face plate 82 and the electron source substrate 81 to each other are placed at given positions. The bonding members in this embodiment are formed by patterning from an In film 93 (See FIG. 11).

The thickness of the In film 93 is determined such that the thickness measured as the sum of the In film 93 on the face plate 82 and the In film 93 on the electron source substrate 81 before bonding 81 and 82 is much larger than the thickness measured after these In films are merged and flattened by bonding 81 and 82. In this embodiment, the In film 93 formed on the face plate 82 and the In film 93 formed on the electron source substrate 81 each have a thickness of 300 μm so that the In film 93 after sealing has a thickness of about 300 μm.

(Formation of a Non-evaporating Getter)

On a metal back 85 of the face plate 82, Ti is deposited by RF sputtering to obtain a 500 Å thick Ti film as a non-evaporating getter 87. The deposition uses a metal mask that has a large opening at the center, so that the non-evaporating getter 87 is formed only within the image display region. In this embodiment, the face plate 82 is once put under an atmosphere whose pressure level is near the atmospheric pressure in order to make the non-evaporating getter (thin film Ti getter) 87 adsorb gas sufficiently. Then another thin layer of Ti getter is formed by deposition through RF sputtering to a thickness of 2.5 μm solely on black conductors 91 (FIG. 12A). Used in patterning this thin film is a metal mask that has small openings arranged so as to coincide with the black conductors 91. If the metal mask is a thin Ni plate and is fixed by magnets placed on the back, it gives the getter material less opportunity to run astray during the patterning.

(Set Step)

Next, the electron source substrate 81, the face plate 82 on which the non-evaporating getter 87 is placed, and a supporting frame 86 are set under a vacuum atmosphere.

(Baking Step)

The face plate 82 and the electron source substrate 81 are held at a fixed distance from each other as shown in FIG. 11 and, in this state, subjected to vacuum heating. The temperature in the substrate vacuum baking is set to 300° C. or higher, so that the substrates release gas, the non-evaporating getter 87 is activated, and the panel interior has a sufficient vacuum level when the temperature returns to room temperature. At this point, the In film 93 is in a melted state. The substrates have to be leveled sufficiently in advance so as not to let the molten In flow out.

(Formation of an Evaporating Getter)

After the vacuum baking, the temperature is dropped to 100° C. or so. Then a not-shown evaporating getter material which mainly contains Ba and which is made into a ribbon is energized for flashing to form an evaporating getter 88 to a thickness of 300 Å on the non-evaporating getter 87 of the face plate 82 (See FIG. 12B). Gas generated in flashing of the evaporating getter is quickly adsorbed by the non-evaporating getter and degradation of the evaporating getter is thus prevented.

(Sealing Step)

Next, the temperature is again raised to 180° C., which is higher than the melting point of In. With a positioning device 200 shown in FIG. 11, the gap between the face plate 82 and the electron source substrate 81 is gradually closed until the substrates are bonded, in other words, sealed.

The display panel shown in FIGS. 1A and 1B are manufactured through the above processes. A drive circuit composed of a scanning circuit, a control circuit, a modulation circuit, a direct current voltage supply, etc. is connected to the display panel to obtain a panel-like image display device.

The image display device of this embodiment displays an image by applying a voltage to each electron-emitting device through X direction terminals and Y direction terminals to make the electron-emitting device emit electrons, and applying a high voltage through a high voltage terminal Hv to the metal back 85 which serves as an anode electrode to accelerate the emitted electron beam and crash it into a fluorescent film 84. Consequently, the luminance changes little with time and the incidence of luminance fluctuation with time in the image display region is low.

EMBODIMENT 2

Figure 13A:
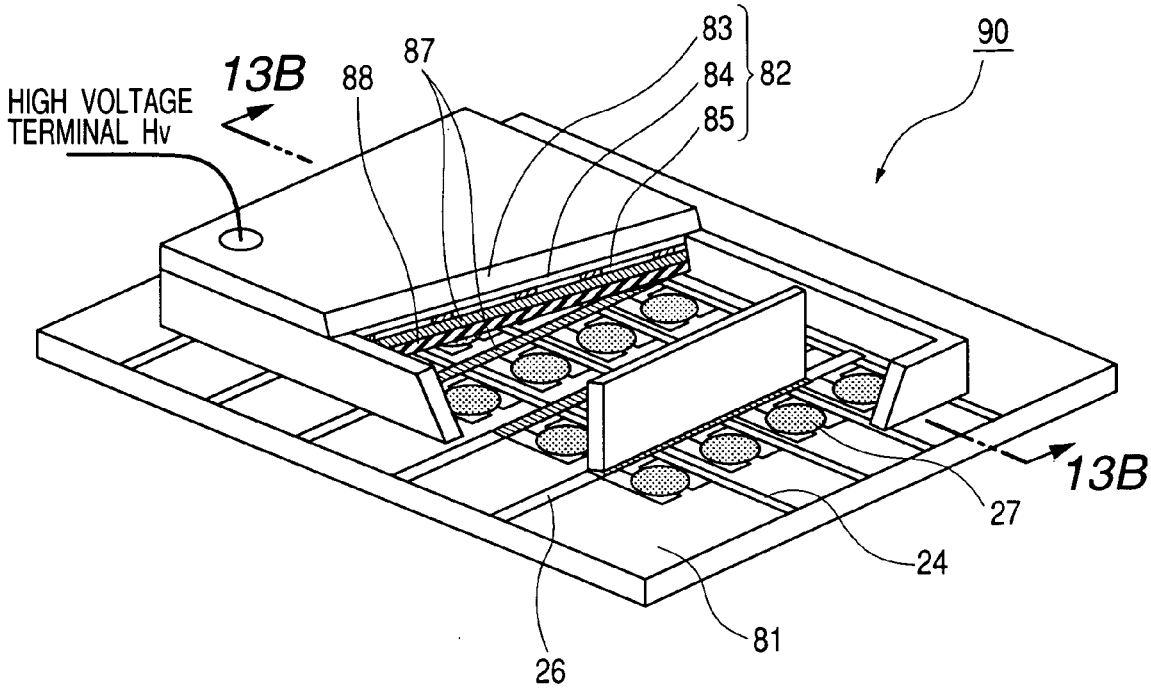
FIGS. 13A and 13B are schematic diagram showing another structural example of an image display device of the present invention.
Figure 13B:
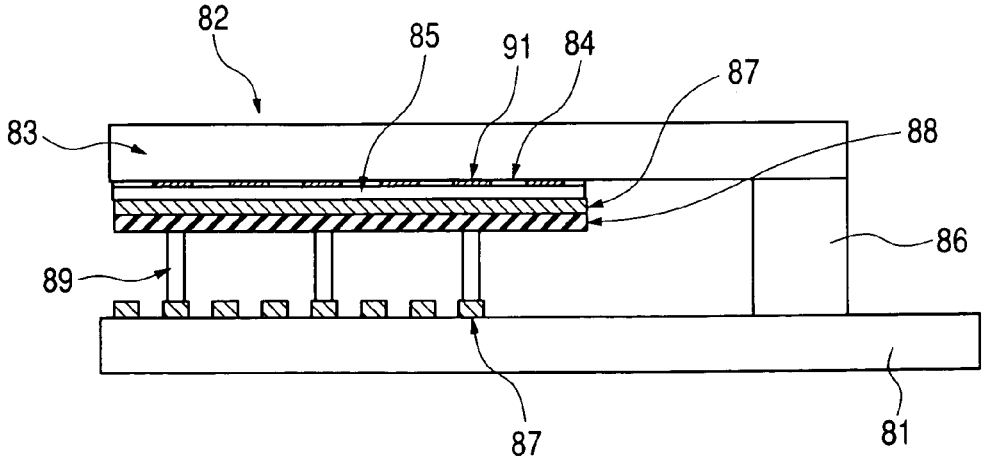

This embodiment describes an example of manufacturing an image display device as the one shown in FIGS. 13A and 13B from an electron source substrate as the one shown in FIG. 2 which has a large number of surface conduction electron-emitting devices connected in accordance with matrix wiring.

FIG. 13A is an overall perspective view schematically showing an image display device. In FIG. 13A, a supporting frame 86 and a face plate 82 are partially cut off in order to illustrate the internal structure of an airtight container 90. FIG. 13B is a partial sectional view taken along the line 1B—1B in FIG. 13A. In FIGS. 13A and 13B, components identical to those in FIGS. 1A and 1B are denoted by the same symbols.

Unlike Embodiment 1 where an additional thin film Ti getter is formed on the black conductors 91 alone, this embodiment places an additional non-evaporating getter 87 also on the X direction wirings 26 of the electron source substrate 81.

Formation of the non-evaporating getter 87 on the X direction wirings can be put after formation of the conductive film 27 or after the activation step. In this embodiment, a thin film Ti getter is formed by deposition through RF sputtering to a thickness of 2.5 μm after the device activation step. Used in patterning this thin film is a metal mask that has small openings arranged so as to coincide with the X direction wirings 26. If the metal mask is a thin Ni plate and is fixed by magnets placed on the back, it gives the getter material less opportunity to run astray during the patterning.

In this embodiment, the supporting frame 86 is set on the side of the face plate 82 in advance.

The image display device manufacturing process of this embodiment is identical with the one in Embodiment 1 except the above points. The image display device of this embodiment displays an image by applying a voltage to each electron-emitting device through X direction terminals and Y direction terminals to make the electron-emitting device emit electrons, and applying a high voltage through a high voltage terminal Hv to the metal back 85 which serves as an anode electrode to accelerate the emitted electron beam and crash it into a fluorescent film 84. Consequently, the luminance changes little with time and the incidence of luminance fluctuation with time in the image display region is low.

EMBODIMENT 3

In this embodiment, steps from a device electrode formation step through a bonding member placement step are identical with those in Embodiment 1.

(Set Step)

Next, the electron source substrate 81 to which the supporting frame 86 is fixed and the face plate 82 are set under a vacuum atmosphere as shown in FIG. 11.

(Formation of a Non-Evaporating Getter)

Figure 16A:
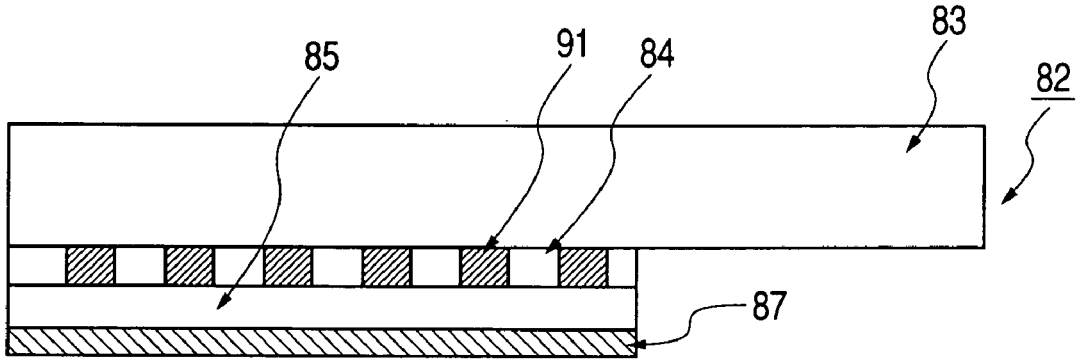
FIGS. 16A and 16B are diagrams illustrating a process of forming a non-evaporating getter and an evaporating getter on an image display member in Embodiment 3.

On the metal back 85 of the face plate 82, Ti is deposited by RF sputtering to obtain a 500 Å thick Ti film as a non-evaporating getter 87 (See FIG. 16A). The deposition uses a metal mask that has a large opening at the center, so that the non-evaporating getter 87 is formed only within the image display region.

(Baking Step)

The face plate 82 and the electron source substrate 81 are held at a fixed distance from each other as shown in FIG. 11 and, in this state, subjected to vacuum heating. The temperature in the substrate vacuum baking is set to 300° C. or higher, so that the substrates release gas, the non-evaporating getter 87 is activated, and the panel interior has a sufficient vacuum level when the temperature returns to room temperature. At this point, the In film 93 is in a melted state. The substrates have to be leveled sufficiently in advance so as not to let the molten In flow out.

(Formation of an Evaporating Getter)

Figure 16B:
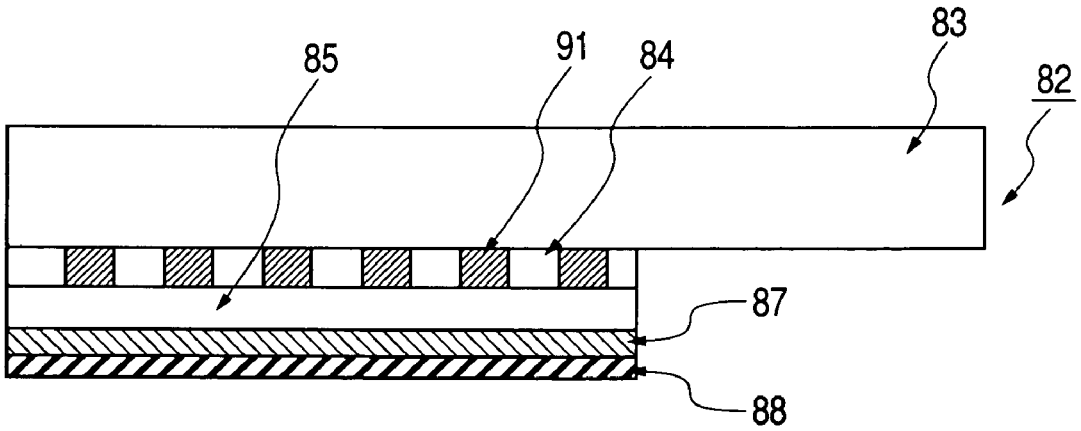

After the vacuum baking, the temperature is dropped to 100° C. or so. Then a not-shown evaporating getter material which mainly contains Ba (not shown) and which is made into a ribbon is energized for flashing to form an evaporating getter 88 to a thickness of 300 Å on the non-evaporating getter 87 of the face plate 82 (See FIG. 16B). Gas generated in flashing of the evaporating getter is quickly adsorbed by the non-evaporating getter 87 and degradation of the evaporating getter is thus prevented.

(Sealing Step)

Next, the temperature is again raised to 180° C., which is higher than the melting point of In. With a positioning device 200 shown in FIG. 11, the gap between the face plate 82 and the electron source substrate 81 is gradually closed until the substrates are bonded, in other words, sealed.

The display panel shown in FIGS. 1A and 1B are manufactured through the above processes. A drive circuit composed of a scanning circuit, a control circuit, a modulation circuit, a direct current voltage supply, etc. is connected to the display panel to obtain a panel-like image display device.

The image display device of this embodiment displays an image by applying a voltage to each electron-emitting device through X direction terminals and Y direction terminals to make the electron-emitting device emit electrons, and applying a high voltage through a high voltage terminal Hv to the metal back 85 which serves as an anode electrode to accelerate the emitted electron beam and crash it into a fluorescent film 84. Consequently, the luminance changes little with time and the incidence of luminance fluctuation with time in the image display region is low.

EMBODIMENT 4

Figure 17:
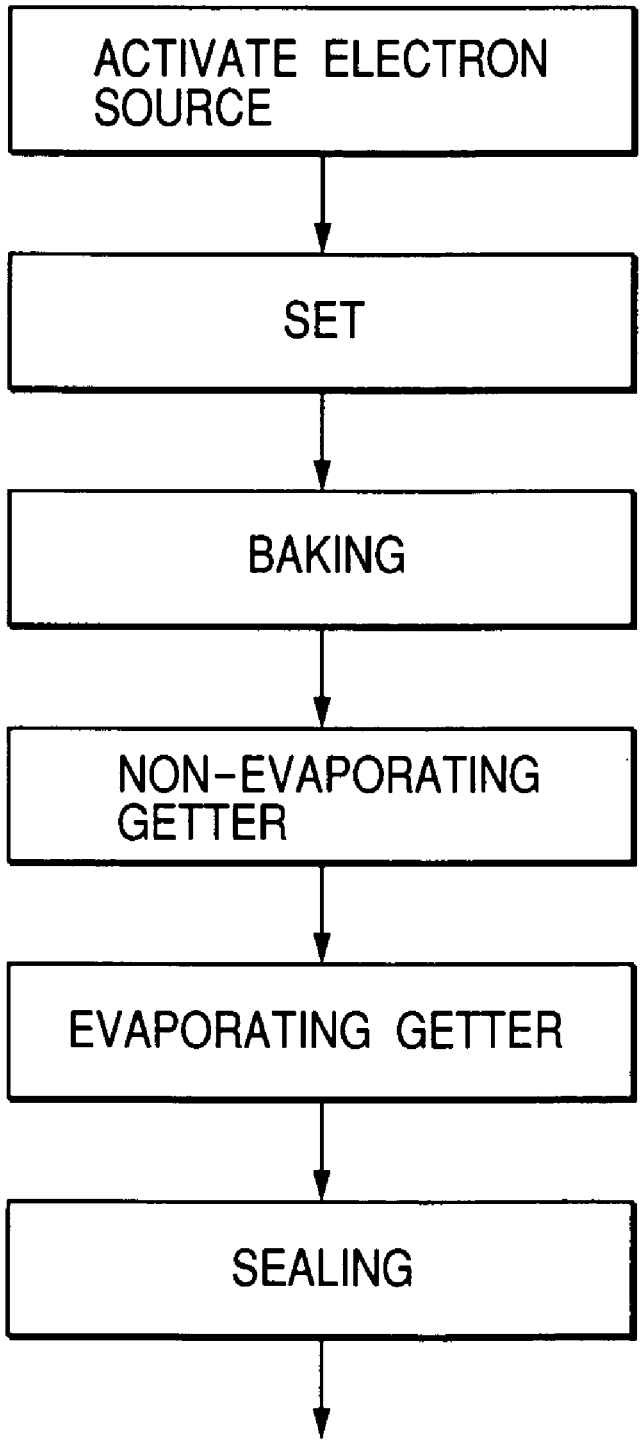
FIG. 17 is a process step flow chart illustrating another example of a method of manufacturing an image display device in accordance with the present invention.

An image display device as the one shown in FIGS. 1A and 1B is manufactured by a process shown in a process step flow chart of FIG. 17. This manufacturing process is identical with the one described in Embodiment 3 except that the places of the non-evaporating getter step and the baking step in the process order of Embodiment 3 are switched.

The image display device of this embodiment displays an image by applying a voltage to each electron-emitting device through X direction terminals and Y direction terminals to make the electron-emitting device emit electrons, and applying a high voltage through a high voltage terminal Hv to the metal back 85 which serves as an anode electrode to accelerate the emitted electron beam and crash it into a fluorescent film 84. Consequently, the luminance changes little with time and the incidence of luminance fluctuation with time in the image display region is low.

EMBODIMENT 5

Figure 18:
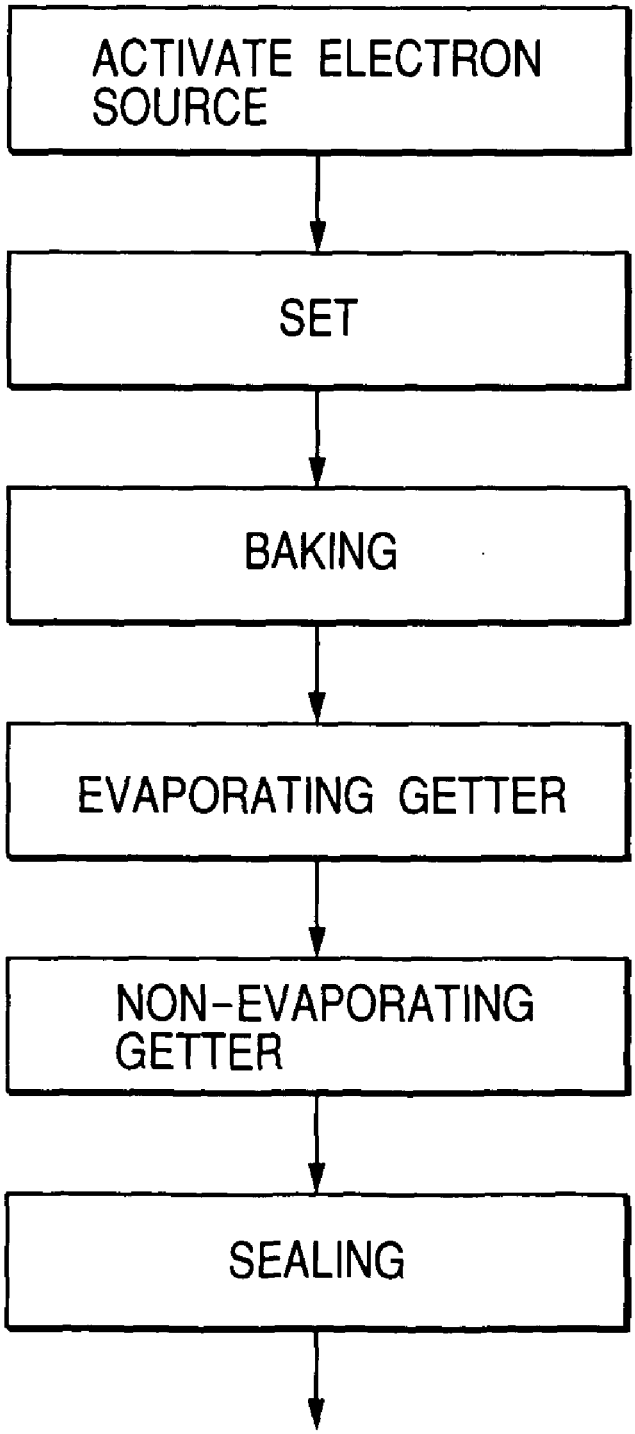
FIG. 18 is a process step flow chart illustrating still another example of a method of manufacturing an image display device in accordance with the present invention.

An image display device as the one shown in FIGS. 1A and 1B is manufactured by a process shown in a process step flow chart of FIG. 18. This manufacturing process is identical with the one described in Embodiment 4 except that the places of the non-evaporating getter step and the evaporating getter step in the process order of Embodiment 4 are switched. In this embodiment, the baking step is followed by the evaporating getter step and then a non-evaporating getter is immediately formed on the evaporating getter.

The image display device of this embodiment displays an image by applying a voltage to each electron-emitting device through X direction terminals and Y direction terminals to make the electron-emitting device emit electrons, and applying a high voltage through a high voltage terminal Hv to the metal back 85 which serves as an anode electrode to accelerate the emitted electron beam and crash it into a fluorescent film 84. Consequently, the luminance changes little with time and the incidence of luminance fluctuation with time in the image display region is low.

The present invention can provide an image display device in which the luminance changes little with time (less degradation with age).

The present invention can also provide an image display device in which the incidence of luminance fluctuation with time in an image display region is low.

What is claimed is:

1. An image display device comprising, in an airtight container, an electron source, an image display member, and a getter film, the image display member facing the electron source to receive electrons from the electron source, wherein the getter film comprises an evaporating getter film and a non-evaporating getter film laminated successively on said image display member in the airtight container.

2. An image display device according to claim 1, wherein the getter film extends over a region of the image display member that receives the electrons.

3. An image display device according to claim 1, wherein the getter film is constituted by placing first the non-evaporating getter film on a getter film placement face and then laying the evaporating getter film on the non-evaporating getter film.

4. An image display device according to claim 3, wherein the evaporating getter film is thinner than the non-evaporating getter film.

5. An image display device according to claim 1, wherein the getter film is constituted by placing first the evaporating getter film on a getter film placement face and then laying the non-evaporating getter film on the evaporating getter film.

6. An image display device comprising, in an airtight container, an electron source, an image display member, and a getter film, the image display member including a metal back and facing the electron source to receive electrons from the electron source, wherein the getter film comprises an evaporating getter film and a non-evaporating getter film laminated successively on said metal back in the airtight container.

7. An image display device according to claim 6, wherein the getter film extends over a region of the image display member that receives the electrons.

8. An image display device according to claim 6, wherein the getter film is constituted by placing first the non-evaporating getter film on a metal back placement face and then laying the evaporating getter film on the non-evaporating getter film.

9. An image display device according to claim 8, wherein the evaporating getter film is thinner than the non-evaporating getter film.

10. An image display device according to claim 6, wherein the getter film is constituted by placing first the evaporating getter film on a metal back placement face and then laying the non-evaporating getter film on the evaporating getter film.

11. An image display device comprising, in an airtight container, an electron source, an image display member, and a getter film, the image display member facing the electron source to receive electrons from the electron source, wherein the getter film comprises a first getter film and a second getter film of an ingredient different from that of the first getter film, the first and second getter films being laminated successively on said image display member in the airtight container.

12. An image display device according to claim 11, wherein the getter film extends over a region of the image display member that receives the electrons.

13. An image display device comprising, in an airtight container, an electron source, an image display member including a metal back, and a getter film, the image display member facing the electron source to receive electrons from the electron source, wherein the getter film comprises a first getter film and a second getter film of an ingredient different from that of the first getter film, the first and second getter films being laminated successively on said metal back in the airtight container.

14. An image display device according to claim 13, wherein the getter film extends over a region of the image display member that receives the electrons.

* * * * *

UNITED STATES PATENT AND TRADEMARK OFFICE

CERTIFICATE OF CORRECTION

PATENT NO. : 7,091,662 B2
APPLICATION NO. : 10/624637
DATED : August 15, 2006
INVENTOR(S) : Mitsutoshi Hasegawa et al.

It is certified that error appears in the above-identified patent and that said Letters Patent is hereby corrected as shown below:

COLUMN 1

Line 42, “before” should read --before being--.

COLUMN 3

Line 20, “before” should read --before being--.

COLUMN 5

Line 10, “diagram” should read --diagrams--.

COLUMN 8

Line 28, “suite” should read --suit--; and
Line 51, “suite” should read --suit--.

COLUMN 9

Line 48, “suite” should read --suit--.

Signed and Sealed this

Twenty-first Day of August, 2007

JON W. DUDAS
*Director of the United States Patent and Trademark Office*